US007747198B2

(12) United States Patent
Nakagami

(10) Patent No.: US 7,747,198 B2
(45) Date of Patent: Jun. 29, 2010

(54) TONER CARTRIDGE, PROCESS CARTRIDGE, IMAGE CARTRIDGE, AND IMAGE FORMING APPARATUS TO WHICH THOSE CARTRIDGES ARE ATTACHABLE

(75) Inventor: Hidekazu Nakagami, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 237 days.

(21) Appl. No.: 11/704,347

(22) Filed: Feb. 9, 2007

(65) Prior Publication Data

US 2007/0196136 A1 Aug. 23, 2007

(30) Foreign Application Priority Data

Feb. 20, 2006 (JP) ..... 2006-042766
Feb. 24, 2006 (JP) ..... 2006-048328

(51) Int. Cl.
*G03G 15/08* (2006.01)

(52) U.S. Cl. ..... 399/260; 399/258

(58) Field of Classification Search ..... 399/119, 399/111, 258, 252, 260, 262
See application file for complete search history.

(56) References Cited

U.S. PATENT DOCUMENTS 5,608,501 A * 3/1997 Makino ..... 399/119
2002/0085857 A1* 7/2002 Kim et al. ..... 399/119
2004/0091288 A1* 5/2004 Yahagi ..... 399/258
2006/0029422 A1* 2/2006 Shiraki ..... 399/111
2007/0212118 A1* 9/2007 Nagae et al. ..... 399/260

FOREIGN PATENT DOCUMENTS

| | | |
|---|---|---|
| JP | 6-35318 | 2/1994 |
| JP | 6-21051 | 3/1994 |
| JP | 7-152239 | 6/1995 |
| JP | 7-168435 | 7/1995 |
| JP | 9-101733 | 4/1997 |
| JP | 09101733 A * | 4/1997 |
| JP | 9-274347 | 10/1997 |

(Continued)

OTHER PUBLICATIONS

Japanese Office Action, mailed Aug. 19, 2008, directed to counterpart foreign Application No. JP-2006-042766; 7 pages.

(Continued)

*Primary Examiner*—David M Gray
*Assistant Examiner*—Billy J Lactaoen
(74) *Attorney, Agent, or Firm*—Morrison & Foerster LLP

(57) ABSTRACT

A toner cartridge and a process cartridge, individually, have a shutter which makes sliding movement by opening and closing their toner inlet and toner outlet. When those cartridges are attached to a color printer and fixed together by a fixing lever, the shutters of both cartridges and the fixing lever can move together as one. When they make sliding movement together, both of the shutters are opened and toner supply becomes available. There are thus realized a toner cartridge, a process cartridge, an imaging cartridge, and an image forming apparatus to which those cartridges are attachable, all of which can prevent toner leakage from both a toner housing portion and a process portion and enables even an unaccustomed user to attach each cartridge without making surroundings dirty.

7 Claims, 30 Drawing Sheets

FOREIGN PATENT DOCUMENTS

| | | |
|---|---|---|
| JP | 10-236688 | 9/1998 |
| JP | 2000-98713 | 4/2000 |
| JP | 2003-316137 | 11/2003 |
| JP | 2005-134686 | 5/2005 |
| JP | 2006-11233 | 1/2006 |

OTHER PUBLICATIONS

Japanese Office Action, mailed Aug. 19, 2008, directed to counterpart foreign Application No. JP-2006-048328; 5 pages.
Japanese Office Action mailed on Apr. 14, 2009 directed at counterpart application No. 2006-042766;8 pages.

* cited by examiner

TONER CARTRIDGE, PROCESS CARTRIDGE, IMAGE CARTRIDGE, AND IMAGE FORMING APPARATUS TO WHICH THOSE CARTRIDGES ARE ATTACHABLE

CROSS-REFERENCE TO RELATED APPLICATIONS

This application is based upon and claims the benefit of priority from the prior Japanese Patent Applications Nos. 2006-042766 and 2006-048328 filed on Feb. 20, 2006 and Feb. 24, 2006, respectively, the entire contents of which are incorporated herein by reference.

BACKGROUND OF THE INVENTION

1. Field of the Invention

The present invention relates to an electrophotographic type image forming apparatus and various cartridges which are attached to and detached from the apparatus. More particularly, it relates to a toner cartridge for housing toner, a process cartridge including a process portion, e.g. a developing apparatus or the like, an imaging cartridge including a toner cartridge and a process cartridge therein, and an image forming apparatus to which the above cartridges are attachable.

2. Description of the Related Art

Conventionally, in an electrophotographic type image forming apparatus, a developing apparatus installed therein develops an electrostatic latent image formed on an image carrier with toner and an image is formed thereby. There has occasionally been used an image forming apparatus of which toner housing portion and process portion including a developing apparatus portion are provided as separate units. The toner housing portion and the process portion of such a type image forming apparatus are separately attached to and detached from the main body. Generally, when both of them are attached to a main body of the apparatus and it is in an image-formation-possible state, toner is carried via a toner carrying tube which connects the toner housing portion and the process portion.

When the toner housing portion or the process portion is removed, it is required to prevent toner from dropping out inside the apparatus. Therefore, there has generally been devised a method that a toner carrying tube or the like for connecting units is placed aside or closed. On the other hand, Japanese Unexamined Patent Publication No. 2000-98713 discloses an image forming apparatus of which toner carrying tube is divided at its halfway. According to the Publication, both separated ends of the tube are connected to units, respectively. The tube is connected and disconnected along attachment and detachment of the units. The Publication further discloses an image forming apparatus equipped with a shutter at a connecting portion of a toner carrying tube, wherein the shutter opens and closes along with attachment and detachment of units.

Japanese Unexamined Patent Publication No. 07-152239 discloses an image forming apparatus in which a slide shutter is arranged on a bottom face of a toner cartridge. According to the Publication, a toner cartridge and a toner hopper are engaged with a locking member. Lock with the locking member is unlocked by closing the slide shutter. The mechanism allows a user to detach the toner cartridge when the slide shutter is closed.

However, the above-mentioned conventional image forming apparatuses had the following problems. As to the image forming apparatus directed to the Publication No. 2000-98713, the shutter is opened and closed along attachment and detachment of the units, so the shutter is half-opened in the middle of attachment and detachment operations. Therefore, in the case a user stops attachment or detachment operation in the middle and tries it again from the beginning or in the case a user cannot carry out attachment and detachment operation smoothly, toner can possibly run out from the half-opened shutter.

Furthermore, the image forming apparatus directed to the Publication No. 07-152239 cannot carry out image formation if a user forgets to open the slide shutter after a toner cartridge is attached. Furthermore, since no shutter is provided at its toner hopper side, toner can possibly scatter in the middle of attachment and detachment operation. That is, if a user wishes to keep his/her hands and surrounding clean from toner when attaching and detaching a unit of those conventional apparatus, careful and smooth attachment and detachment operation is demanded. However, proper operation was not easy for a user who rarely carries out the operation.

SUMMARY OF THE INVENTION

The present invention has been attempted to solve the above-noted problems involved in the conventional image forming apparatuses. Thus, an object of the invention is to provide a toner cartridge, a process cartridge, an imaging cartridge, and an image forming apparatus to which those cartridges are attachable, all of which can prevent toner leakage from both a toner housing portion and a process portion and enables even an unaccustomed user to attach each cartridge without making surroundings dirty.

To achieve the above object, according to a first aspect of the present invention, there is provided a toner cartridge for housing toner and supplying toner from a toner outlet for forming an image, being attached to an image forming apparatus when used, the toner cartridge comprising: a shutter which has a toner passage hole and makes sliding movement within a range including a closing position to close the toner outlet and an opening position to open the toner outlet through the toner passage hole; a first claw which is fixedly arranged; and a second claw which is arranged on the shutter and blocks the movement of the shutter to the opening position from the closing position by engaging with the first claw.

According to the toner cartridge of the first aspect, engagement of the first claw and the second claw blocks the shutter's moving to the opening position from the closing position. Thereby, the toner outlet is closed and toner leakage from the toner cartridge is prevented, accordingly.

According to the first aspect of the present invention, there is also provided a process cartridge including a process portion for forming an image by receiving toner supplied from a toner inlet, being attached to an image forming apparatus when used, the process cartridge comprising: a shutter which has a toner passage hole and makes sliding movement within a range including a closing position to close the toner inlet and an opening position to open the toner inlet through the toner passage hole; a protrusion member which moves within a range including a protruding position to block the movement of the shutter to the opening position from the closing position and a retreating position not to block the movement of the shutter; and an urging member which urges the protrusion member to the protruding position.

According to the process cartridge of the first aspect, the protrusion member is urged by the urging member, the urged protrusion member blocks the shutter's moving to the opening position from the closing position. That is, since a toner inlet is closed, toner leakage is prevented.

According to the first aspect of the present invention, there is also provided an imaging cartridge which incorporates the toner cartridge and the process cartridge directed to the first aspect of the invention. The shutter of the toner cartridge has the convex portion which protrudes toward the process cartridge. The convex portion is to make a protrusion member to a retreating position by fixing the toner cartridge to the process cartridge. The process cartridge for this imaging cartridge has a fixing lever for fixing the toner cartridge. The fixing lever releases engagement of the first claw and the second claw while fixing the toner cartridge to the process cartridge. The protrusion member of the process cartridge protrudes toward the toner cartridge at its protruding position.

The imaging cartridge of the first aspect is divided into a toner cartridge and a process cartridge, and toner leakage from the respective cartridges is prevented. Furthermore, since the fixing lever is provided, closing positions of shutters set by the claws of the toner cartridge and the protrusion members of the process cartridge are cancelled once the toner cartridge and the process cartridge are fixed by the fixing lever.

According to the first aspect of the present invention, there is also provided an image forming apparatus used by attaching the imaging cartridge directed to the first aspect of the present invention and comprising a movable cover to open and close an attaching portion of the toner cartridge and the process cartridge. Closing of the movable cover is prevented by the fixing lever which does not fix the toner cartridge yet. Closing of the movable cover is also prevented by at least one of the following two items, namely, the fixing lever, and the upper and lower shutters on condition that the both of the shutters are in closed position.

According to the image forming apparatus of the first aspect, toner leakage from toner cartridge and the process cartridge is prevented. Furthermore, since the movable cover is provided, closing of the movable cover is prevented when either one of the cartridges is not attached or the shutters are not appropriately opened. Therefore, even an unaccustomed can easily detect whether or not each cartridge has surely been attached.

According to a second aspect of the present invention, there is provided a toner cartridge for housing toner and supplying toner for forming an image, being attached to an image forming apparatus when used, the toner cartridge comprising: a cylindrical shutter which has a toner passage hole, and rotates within an angular range including a closing position to close a toner path and an opening position to open the toner path through the toner passage hole; a gear which rotates together with the cylindrical shutter; a rotation blocking member which moves within a range including a rotation blocking position engaging with the gear and a retreating position not engaging with the gear; and an urging member which urges the rotation blocking member to the rotation blocking position. According to the toner cartridge directed to the second aspect of the present invention, the toner passage is closed by the cylindrical shutter and rotation of the cylindrical shutter is blocked by the rotation blocking member. Thereby, toner leakage from the toner cartridge is prevented.

According to the second aspect of the present invention, there is also provided a process cartridge including a process portion for forming an image by receiving supply of toner, being attached to an image forming apparatus when used, the process cartridge comprising: a cylindrical shutter which has a toner passage hole, and rotates within an angular range including a closing position to close a toner path and an opening position to open the toner path through the toner passage hole; a gear which rotates together with the cylindrical shutter; a rotation blocking member which moves within a range including a rotation blocking position engaging with the gear and a retreating position not engaging with the gear; and an urging member which urges the rotation blocking member to the rotation blocking position. According to the process cartridge directed to the second aspect of the present invention, the toner passage is closed by the cylindrical shutter and rotation of the cylindrical shutter is blocked by the rotation blocking member. Thereby, toner leakage from the process cartridge is prevented.

According to the second aspect of the present invention, there is also provided an imaging cartridge which incorporates the toner cartridge and the process cartridge directed to the second aspect of the invention. The toner cartridge for this imaging cartridge has an operation transmitting portion which receives driving force to rotate a cylindrical shutter. The process cartridge for this imaging cartridge has a fixing lever which fixes the toner cartridge to the process cartridge and an operation key provided on the fixing lever. The fixing lever makes both the upper rotation blocking member and the lower rotation blocking member retreat to respective retreating positions when the toner cartridge is fixed to the process cartridge. The operation key gets engaged with the operation transmitting portion when the toner cartridge is fixed by the fixing lever. The upper gear and the lower gear are engaged with each other on condition that the toner cartridge is fixed to the process cartridge.

The imaging cartridge of the second aspect is divided into a toner cartridge and a process cartridge, and toner leakage from the respective cartridges is prevented. Furthermore, since the fixing lever is provided, both of the rotation blocking members are retreated once the toner cartridge and the process cartridge are fixed by the fixing lever. Thereby, both of the cylindrical shutters are set in rotatable condition. Furthermore, when both of the gears get engaged with each other, the cylindrical shutter of the process cartridge is rotated, i.e., the cylindrical shutter of the toner cartridge is rotated with the operation key and the rotation is transmitted to the cylindrical shutter of the process cartridge via the gears. Therefore, operation to open the shutters is easy.

According to the second aspect of the present invention, there is also provided an image forming apparatus used by attaching a toner cartridge for housing toner and supplying toner from a toner outlet for forming an image and a process cartridge including a process portion for forming an image by receiving toner supplied from a toner inlet, the image forming apparatus comprising a movable cover to open and close an attaching portion of the toner cartridge and the process cartridge, wherein the image forming apparatus further comprising: a toner cartridge rail which provides a movement path for attaching and detaching the toner cartridge, and makes the toner outlet separate from the process cartridge at a position more front than operational position for the toner cartridge; a process cartridge rail which provides a movement path for attaching and detaching the process cartridge taking an allowance in a distance direction from the toner cartridge; an elastic member which urges the process cartridge on the movement path provided by the process cartridge rail to the toner cartridge; and a fixing member which regulates the process cartridge's approaching to the toner cartridge, and wherein the process cartridge has a protrusion which intervenes with the fixing member at a position in front of the process cartridge's operational position.

According to the image forming apparatus of the second aspect, since the toner cartridge rail and the process cartridge rail are provided, both of the cartridges are separated and moved respectively when each of the cartridges is attached and detached. Thereby, surrounding is prevented from becoming dirty during attachment and detachment operation.

According to a third aspect of the present invention, there is provided a toner cartridge for housing toner and supplying toner from a toner outlet for forming an image, being attached to an image forming apparatus when used, the toner cartridge comprising: a shutter which has a toner passage hole and makes sliding movement within a range including a closing position to close the toner outlet and an opening position to open the toner outlet through the toner passage hole; a cylindrical shutter which is arranged more upstream of toner flow than the shutter, has a toner passage hole, and rotates within an angular range including a closing position to close a toner path and an opening position to open the toner path through the toner passage hole; a gear which rotates together with the cylindrical shutter; and a rack portion which makes sliding movement together with the shutter, is provided in parallel to direction of the sliding movement, and is engaged with the gear, wherein the shutter and the cylindrical shutter come to opening position together, and come to closing position together.

According to the toner cartridge of the third aspect, the toner outlet is opened or closed by the shutter which makes sliding movement and the cylindrical shutter which rotates. Furthermore, since the toner cartridge includes the gear and the rack portion, the cylindrical shutter is rotated along the gear's rotation created by sliding movement of the rack portion. Since the gear and the rack portion get engaged with each other and the rack portion is designed to make sliding movement together with the shutter, opening and closing of the cylindrical shutter is made together with opening and closing of the shutter. Therefore, toner leakage is prevented by the shutter and the cylindrical shutter and even an unaccustomed user can surely attach without making surrounding dirty.

According to the third aspect of the present invention, there is also provided an imaging cartridge which is divided into the toner cartridge and the process cartridge including a process portion for forming an image by receiving toner supply, both directed to the third aspect of the invention. Both of the cartridges are attached to the image forming apparatus when used. The process cartridge has a fixing lever which fixes the toner cartridge, gets engaged with the engaging portion and makes sliding movement together with the upper shutter while fixing the toner cartridge.

According to the imaging cartridge of the third aspect, the upper shutter and the cylindrical shutter are provided on the toner cartridge and they are opened and closed together. Furthermore, the engaging portion and the fixing lever are provided on the toner cartridge and the process cartridge, respectively. When they are engaged with each other, sliding movement is made together with the upper shutter. That is, since opening and closing of the shutters can be made by one time of sliding movement, even an unaccustomed user can surely attach the imaging cartridge without making surrounding dirty.

According to the third aspect of the present invention, there is also provided a process cartridge including a process portion for forming an image by receiving toner supplied from a toner inlet, being attached to an image forming apparatus together with a toner cartridge for supplying toner when used, the process cartridge comprising: a shutter which has a toner passage hole and makes sliding movement within a range including a closing position to close the toner inlet and an opening position to open the toner inlet through the toner passage hole; fixing lever which fixes the toner cartridge along rotational movement; and a lever supporting shaft which is provided apart from the shutter, and supports the fixing lever in a manner that the fixing lever can rotate and make sliding movement in parallel to sliding movement of the shutter.

According to the process cartridge of the third aspect, toner leakage is prevented by the shutter. Furthermore, the fixing lever for fixing the toner cartridge is supported by the lever supporting shaft in a manner that the fixing lever can rotate and make sliding movement. Since the lever supporting shaft is arranged apart from the shutter, the fixing lever can be supported stably and surely.

According to a fourth aspect of the present invention, there is provided an imaging cartridge divided into a toner cartridge for housing toner and supplying toner from a toner outlet for forming an image and a process cartridge including a process portion for forming an image by receiving toner supplied from a toner inlet, both the toner cartridge and the process cartridge being attached to an image forming apparatus when used, wherein the toner cartridge comprises: an upper shutter which has a toner passage hole and makes sliding movement within a range including a closing position to close the toner outlet and an opening position to open the toner outlet through the toner passage hole; and an upper positioning-and-engaging portion which makes sliding movement together with the upper shutter and gets engaged with a member of the process cartridge, wherein the process cartridge comprises: a lower shutter which has a toner passage hole and makes sliding movement within a range including a closing position to close the toner inlet and an opening position to open the toner inlet through the toner passage hole; and a lower positioning-and-engaging portion which makes sliding movement together with the lower shutter and gets engaged with the upper positioning-and-engaging portion, wherein the upper positioning-and-engaging portion and the lower positioning-and-engaging portion get engaged with each other at a position where the toner passage hole of the upper shutter and the toner passage hole of the lower shutter meet each other, wherein the upper shutter and the lower shutter come to opening positions together and come to closing positions together when the upper positioning-and-engaging portion and the lower positioning-and-engaging portion get engaged with each other.

According to the imaging cartridge of the fourth aspect, the upper positioning-and-engaging portion and the lower positioning-and-engaging portion are provided on the toner cartridge and the process cartridge, respectively, and they get engaged with each other at a position where the toner passage hole of the upper shutter and that of the lower shutter meet each other. The upper shutter and the lower shutter in engaged with each other are slid together. Therefore, there never arises an accident that toner passage holes of the upper shutter and the lower shutter deviate from each other and toner leaks from a space formed due to the deviation.

According to a fifth aspect of the present invention, there is provided an imaging cartridge divided into a toner cartridge for housing toner and supplying toner from a toner outlet for forming an image and a process cartridge including a process portion for forming an image by receiving supply of toner, both the toner cartridge and the process cartridge being attached to an image forming apparatus when used, wherein the toner cartridge comprises: an upper shutter which has a toner passage hole and makes sliding movement within a range including a closing position to close the toner outlet and an opening position to open the toner outlet through the toner passage hole; a first engaging portion which makes sliding movement together with the upper shutter and gets engaged with a member of the process cartridge; and a second engaging portion which is arranged apart from the upper shutter and gets engaged with a member of the process cartridge, wherein the process cartridge comprises: a fixing lever which is capable of making both sliding movement in parallel to the upper shutter's sliding movement and rotational movement around slide axis of the sliding movement, and fixes the toner cartridge by rotational movement; a third engaging portion which is provided on the fixing lever, and gets engaged with the first engaging portion and enable the fixing lever and the upper shutter to make sliding movement as one when the toner cartridge is fixed by the fixing lever; and a fourth engaging portion which is provided on the fixing lever, and gets engaged with the second engaging portion and blocks rotational movement of the fixing lever when the toner cartridge is fixed by the fixing lever and the upper shutter is slid to the opening position.

According to the imaging cartridge of the fifth aspect, when the first engaging portion and the third engaging portion get engaged with each other, the upper shutter and the fixing lever make sliding movement together. When the upper shutter is brought to an opening position by the sliding movement, rotational movement of the fixing lever is blocked by engagement of the second engaging portion and the fourth engaging portion. Therefore, the toner cartridge and the process cartridge never get unfixed when the upper shutter is opened.

According to the inventive toner cartridge, process cartridge, imaging cartridge, and image forming apparatus to which those cartridges are attachable, toner leakage from both a toner housing portion and process portion is prevented and even an unaccustomed user can surely attach various cartridge without making surrounding dirty.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENT

First Embodiment

A first embodiment will be described in detail with reference to the accompanying drawings. The first embodiment applies the present invention to a color printer of which toner housing portion and process portion are provided as separable units.

Figure 1:
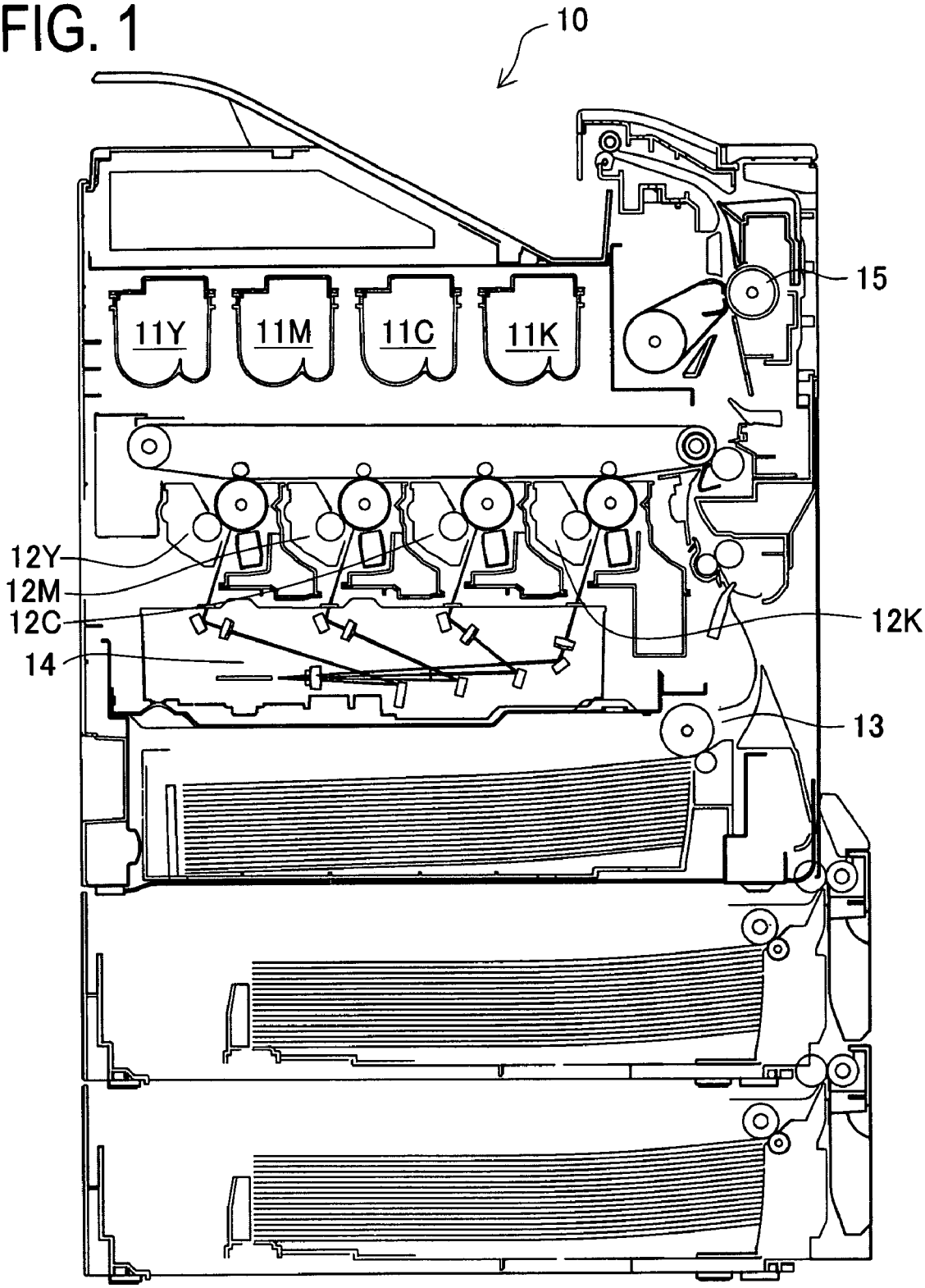
FIG. 1 is a cross sectional view showing schematic structure of a color printer directed to a first embodiment.

As schematically shown in FIG. 1, a color printer 10 is an image forming apparatus which forms a color image using four colors (Y, M, C, and K) of toner. The color printer 10 includes toner cartridges 11Y, 11M, 11C, and 11K and process cartridges 12Y, 12M, 12C, and 12K corresponding to respective four colors. As shown in FIG. 1, units are arranged in a row in a left and right direction, in other words, a front and rear direction of a unit corresponds to a depth direction of the apparatus when it is inserted in there. Since structure of the toner cartridges 11Y, 11M, 11C and 11K are identical, they will be simply indicated as toner cartridges 11 without indicating suffixes Y, M, C, or K, hereafter. Also, since structure of the process cartridges 12Y, 12M, 12C and 12K are identical, they will be simply indicated as process cartridges 12 without indicating suffixes Y, M, C, or K, hereafter.

The color printer 10 has a movable cover at more front than the cross sectioned point of FIG. 1. For example, a movable cover occupies upper half of a front face of the apparatus and pivotally opens from top side to front-downward. When the movable cover is opened, a front-side end of each toner cartridge 11 and each process cartridge 12 can be seen. As shown in FIG. 1, the color printer 10 further includes various image forming components such as a paper carrying apparatus 13, an image forming system 14, an image fixing portion 15 and the like. Since image formation operation is carried out in similar manner as conventional ones, description of it is therefore omitted here.

Figure 2:
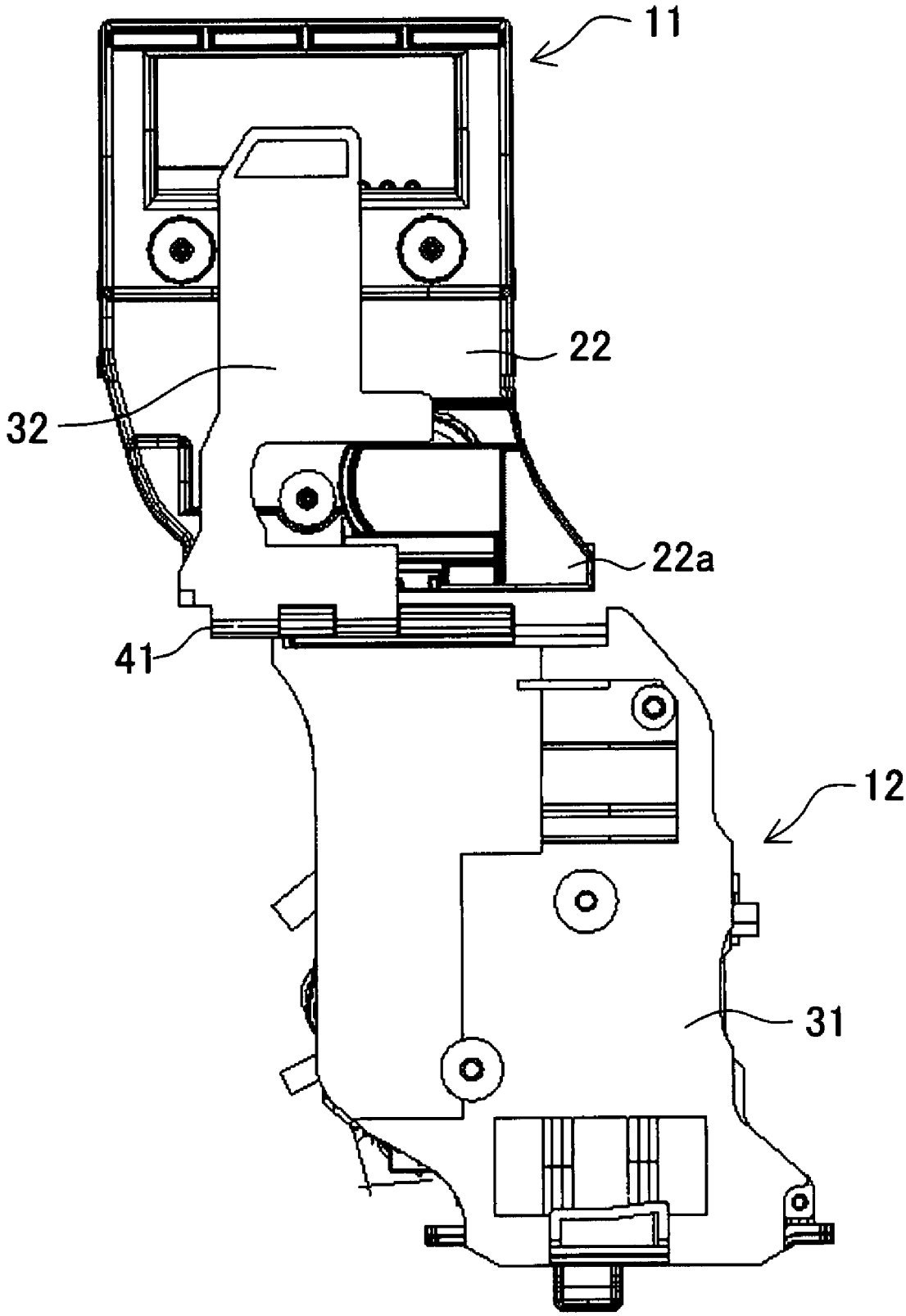
FIG. 2 is a front view showing a state that a toner cartridge and a process cartridge are attached to each other.

Each of the toner cartridges 11 and each of the process cartridges 12 are individually attached to the main body of the color printer 10 and they are removable. When those cartridges are attached to the color printer 10, for each color, a toner cartridge 11 and its counterpart process cartridge 12 are connected with each other, as shown in FIG. 2. FIG. 2 corresponds to a front view of a toner cartridge 11 and a counterpart process cartridge 12 directed to FIG. 1. When the movable cover (see "43" in FIG. 12) provided on a front face of the color printer 10 is opened, four units of respective colors as shown in FIG. 2 can be seen arranged in a row. Under the state as FIG. 2, toner housed in the toner cartridge 11 can be supplied to the process cartridge 12. Hereafter, relative directions of upper, lower, left, and right will be referred based on relative directions in FIG. 2.

Figure 3:
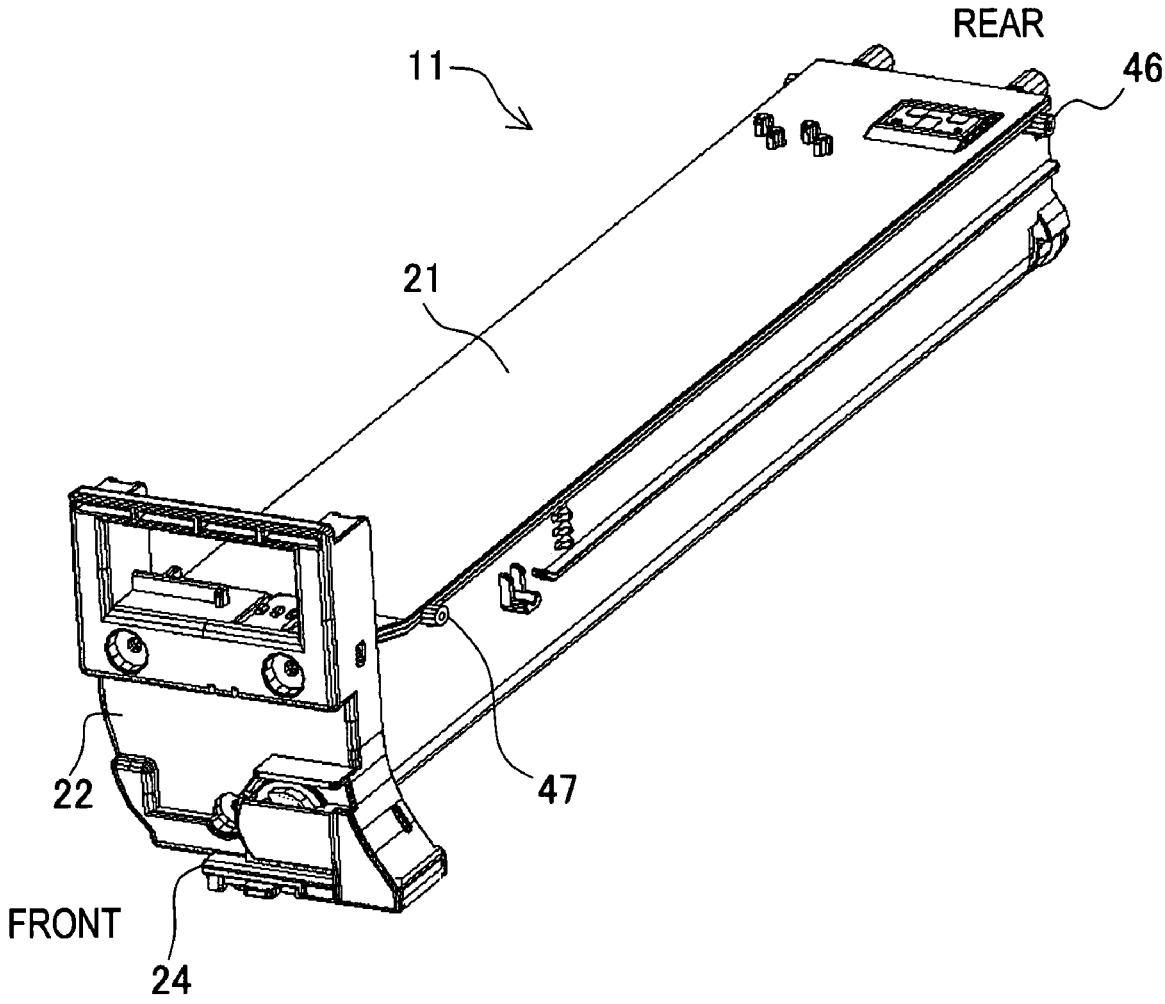
FIG. 3 is an outline view of the toner cartridge.
Figure 4:
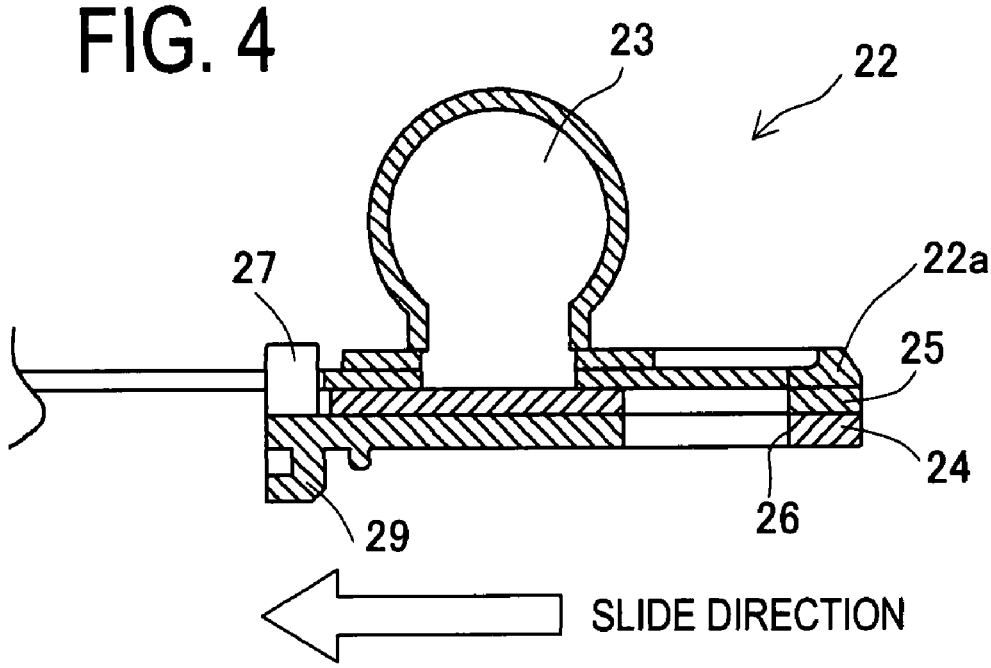
FIG. 4 is a cross sectional view showing a connecting portion of the toner cartridge.

Firstly, there will be described a toner cartridge 11. As shown in FIG. 3, a toner cartridge 11 has a toner housing portion 21 and a connecting portion 22 at rear side and front side, respectively, with reference to a depth direction for FIG. 1. The connecting portion 22 corresponds what is shown in FIG. 2. As shown in FIG. 4, inside of the connecting portion 22, a communicating passage 23 for sending toner in the toner housing portion 21 to a process cartridge is fixedly formed on a main body 22*a* of the connecting portion 22. FIG. 4 shows a partial cross sectional view of the connecting portion 22, specifically, right lower portion for FIG. 3. As shown in FIG. 4, a shutter 24, which slides in left and right direction, is provided on a lower face of the connecting portion 22.

A seal member 25 with some extent of elasticity is adhered to an upper face of the shutter 24. Communicating holes 26 almost same in shape are formed at the shutter 24 and at the seal member 25, respectively, at a position where they meet each other in a vertical direction. Those communicating holes 26 are formed out substantially same as an opening portion (lower side in FIG. 4) of the communicating passage 23 in size and shape. Therefore, the communicating passage 23 and the communicating holes 26 come to passable by sliding the shutter 24 leftward. FIG. 4 shows a state that the communicating passage 23 is closed by the shutter 24.

Figure 5:
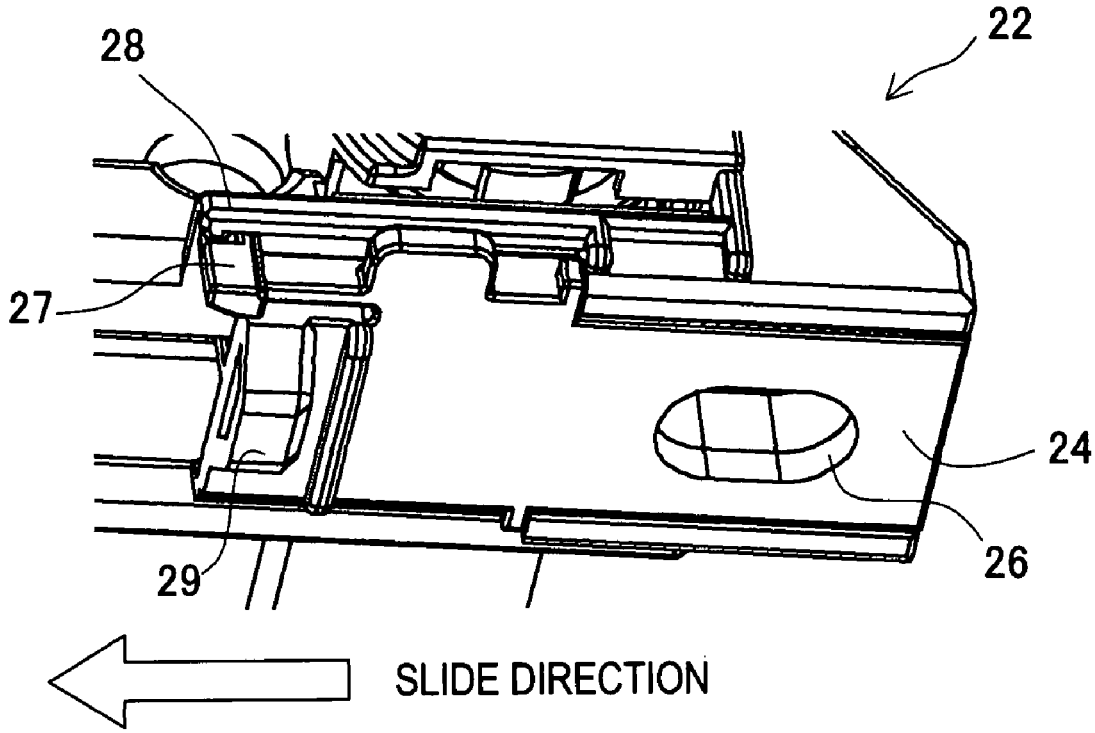
FIG. 5 is a perspective view showing the connecting portion of the toner cartridge.

FIG. 5 shows a state of the connecting portion 22 corresponding to a view of front bottom side for FIG. 2. A claw 27 is formed on the shutter 24. A claw 28 is formed on the main body 22*a* of the connecting portion 22. The claw 27 and the claw 28 are engaged with each other at their tip portions. Therefore, the shutter 24 cannot be slid in a left direction when they are engaged. That is, in a natural state, the communicating passage 23 is closed by the shutter 24 and sliding motion of the shutter 24 is regulated by the claws 27 and 28. Therefore, careless toner leakage from a toner cartridge 11 as a solo item is prevented. It is to be noted that the claw 27 has some extent of elasticity so engagement with the claw 28 can be cancelled when it is pushed to a certain direction. Furthermore, a convex portion 29 is formed on a lower face of the shutter 24.

Next, there will be described a process cartridge 12. In FIG. 2, there can be seen a connecting portion 31 in front and a process portion is formed behind the connecting portion 31 (around '52' in FIG. 16). A fixing lever 32 is attached to the connecting portion 31 of the process cartridge 12, at front face for FIG. 2. The fixing lever 32 is a plate-like member and a rotation shaft 41 is arranged on an upper portion of the connecting portion 31 for the fixing lever 32. When each unit is attached or detached, the fixing lever 32 is rotated in up-and-down direction and lifted up by a user at front face side. By moving the fixing lever 32 in up-and-down direction, the toner cartridge 11 and the process cartridge 12 is connected or separated. FIG. 2 shows a state that the fixing lever 32 is lifted upward and inserted in the toner cartridge 11 whereby both of the cartridges are connected.

Figure 6:
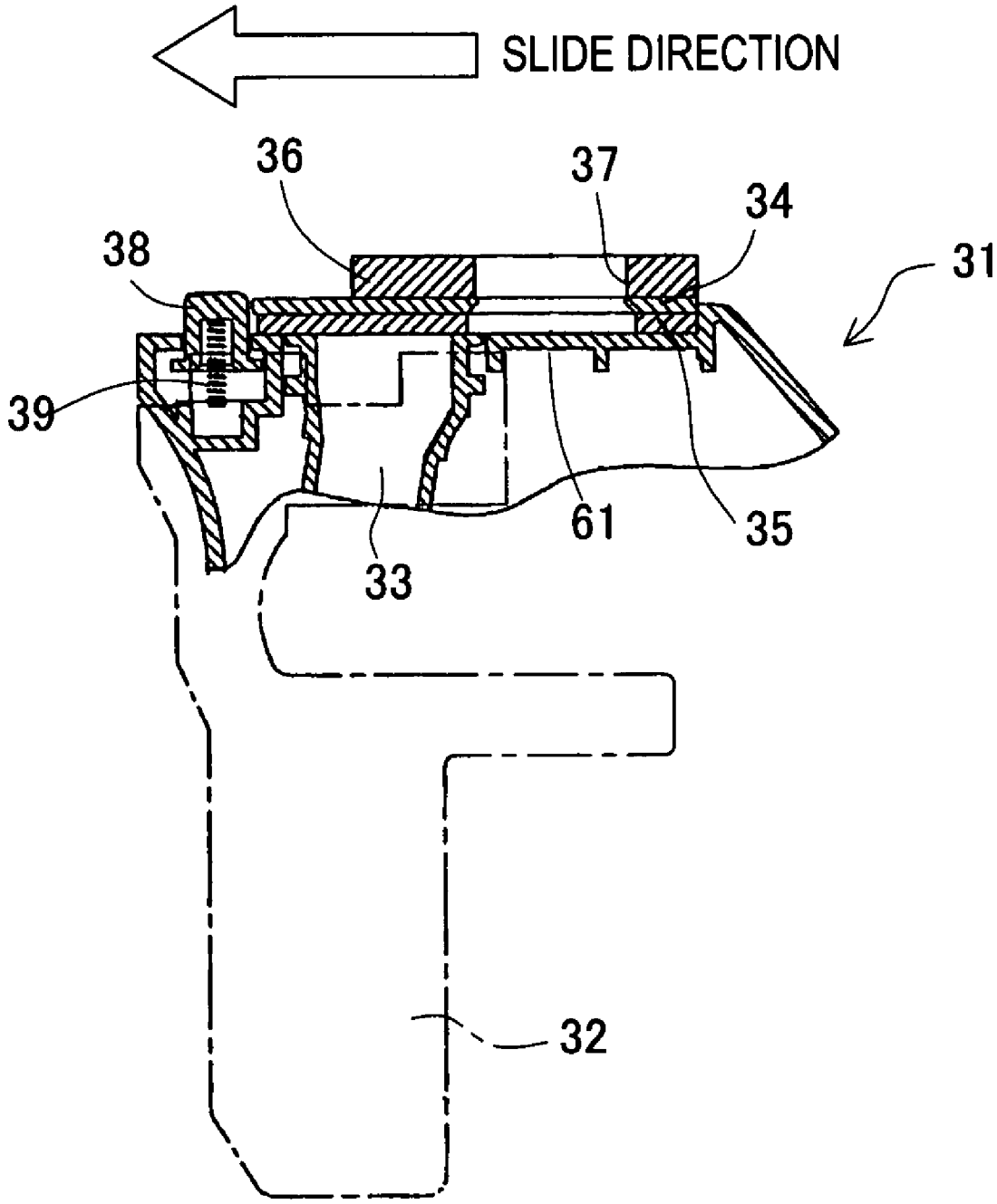
FIG. 6 is a cross sectional view showing a connecting portion of the process cartridge.

FIG. 6 shows a cross sectional view of an upper part of the connecting portion 31 of the process cartridge 12. A communicating passage 33 for accepting toner from the toner cartridge 11 is formed on the connecting portion 31. A shutter 34 which slides in left-and-right direction is attached to an upper face of the connecting portion 31. Furthermore, a seal member 35 with some extent of elasticity is adhered to a lower face of the shutter 34. Furthermore, a packing 36 which surpasses the seal member 35 in thickness and elasticity is adhered to an upper face of the shutter 34. Communicating holes 37 almost same in shape are formed at the shutter 34 and at the seal member 35, respectively, at a position where they meet each other in a vertical direction. The communicating holes 37 are formed out substantially same as the opening portion (upper side in FIG. 6) of the communicating passage 33 in size and shape. Therefore, the communicating passage 33 and the communicating holes 37 come to passable by sliding the shutter 34 leftward. FIG. 6 shows a state that the communicating passage 33 is closed by the shutter 34.

A pin 38 protrudes from the upper face of the connecting portion 31. The pin 38 is urged upward in FIG. 6 by a spring 39. The pin 38 is arranged at left side in FIG. 6. Therefore, the shutter 34 cannot be slide leftward when the pin 38 protrudes. That is, in a natural state, the communicating passage 33 is closed by the shutter 34 and sliding motion of the shutter 34 is regulated by the pin 38. Therefore, careless toner leakage from a process cartridge 12 as a solo item is prevented.

Figure 7:
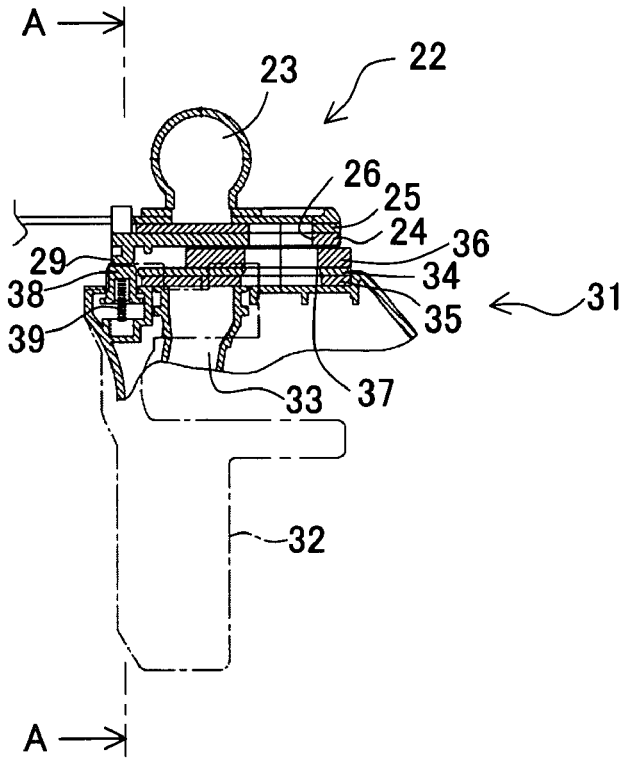
FIG. 7 is a cross sectional view showing a connecting portion of the toner cartridge and the process cartridge.
Figure 8:
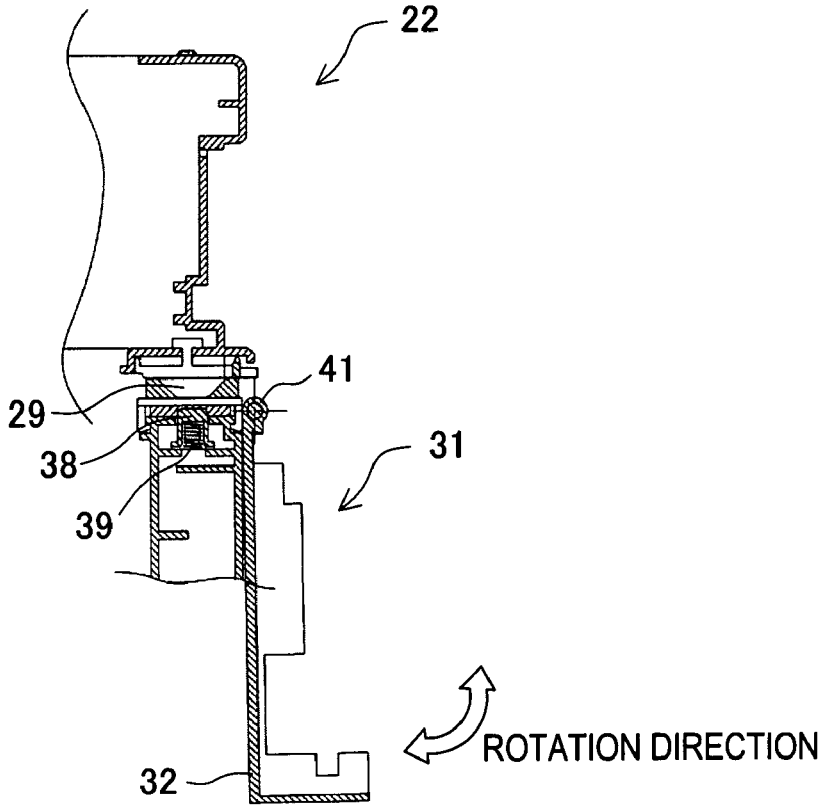
FIG. 8 is a cross sectional view showing the connecting portion of the toner cartridge and the process cartridge.

Next, there will be described a manner of attaching the toner cartridge 11 and the process cartridge 12 to the color printer 10. Those cartridges are inserted in a depth direction from the front side for FIG. 1. When those cartridges are inserted to reach a designated position in the main body, the communicating passage 23 and the communicating passage 33 overlap almost co-axially, as shown in FIG. 7. Furthermore, the communicating holes 26 and the communicating holes 37 overlap in vertical direction. FIG. 8 is a cross sectional view of FIG. 7 sectioned along A-A. In FIG. 8, the fixing lever 32 can be rotated in arrow directions around the center of the rotation axis 41. With this situation, the convex portion 29 on the lower face of the toner cartridge 11 is immediately above the pin 38.

Figure 9:
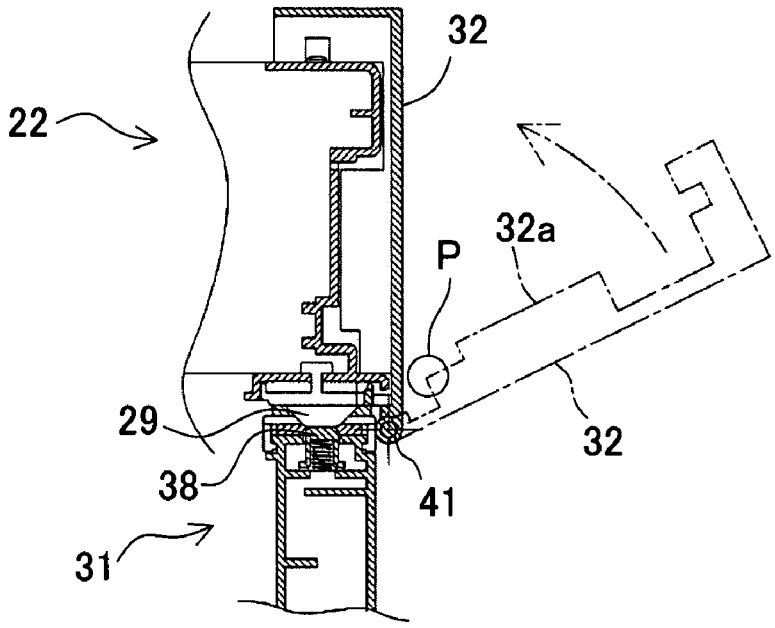
FIG. 9 is a cross sectional view showing the connecting portion of the toner cartridge and the process cartridge.
Figure 10:
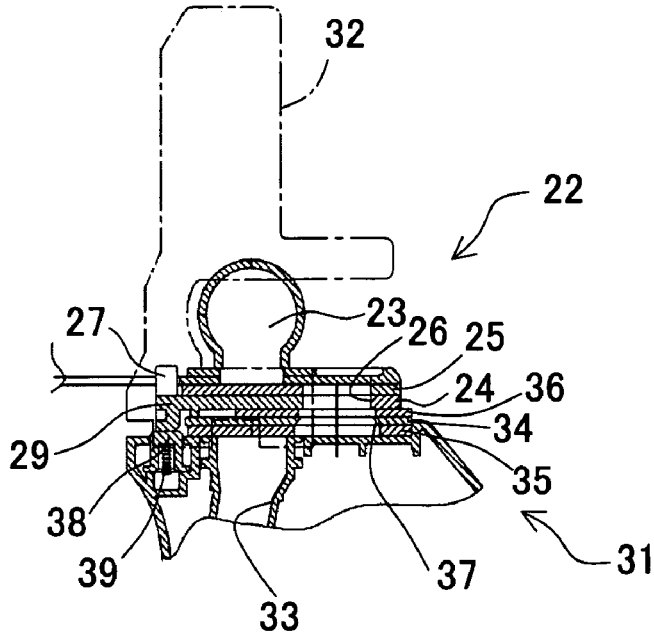
FIG. 10 is a cross sectional view showing the connecting portion of the toner cartridge and the process cartridge.

After both the toner cartridge 11 and the process cartridge 12 are placed in their designated positions, a user rotates the fixing lever 32 upward, as shown in FIG. 9. A user pushes the fixing lever 32 into the front face of the connecting portion 22 (the face appearing as front face in FIG. 2) of the toner cartridge 11 compressing the packing 36 to make the toner cartridge 11 and the process cartridge 12 closer. As shown in FIG. 9, a face 32*a*, an inner side of the fixing lever 32, is formed out to fit with an outer form of the connecting portion 22. Therefore, when the fixing lever 32 is pushed in, the connecting portion 22 is pressed by an upper portion of the fixing lever 32 and vicinity of the rotation axis 41. Thereby, as shown in FIG. 9 and FIG. 10, the packing 36 remains compressed. As a result, the connecting portion 22 and the connecting portion 31 are fixed to be slightly closer compared with the state in FIG. 7 and FIG. 8.

The claw 27 of the connecting portion 22 is pushed by a part of the fixing lever 32 (indicated as a circled portion P in FIG. 9) when the fixing lever 32 is pushed inward. While being pushed, the claw 27 does not get engaged with the claw 28. As a result, the shutter 24 of the toner cartridge 11 is allowed to slide. At the same time, the pin 38 of the connecting portion 31 is pushed by the convex portion 29 on the lower face of the connecting portion 22. Then, the pin 38 is pushed down against urging force of the spring 39. Thereby, the shutter 34 of the process cartridge 12 can slide.

Figure 11:
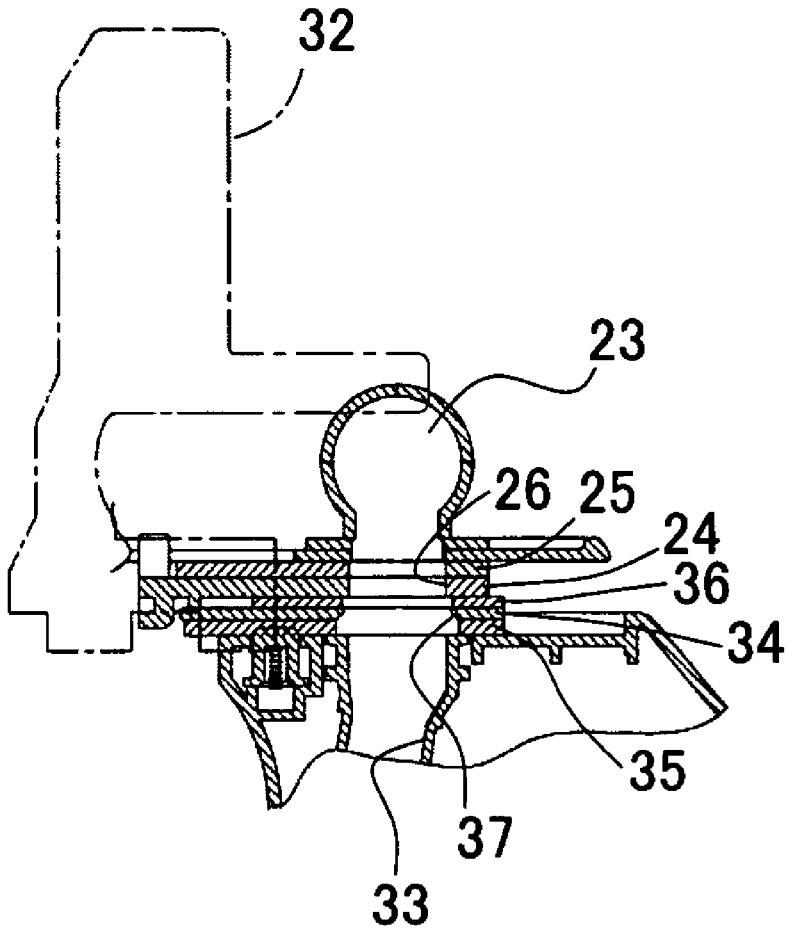
FIG. 11 is a cross sectional view showing the connecting portion of the toner cartridge and the process cartridge.

That is, by pushing the fixing lever 32 to the connecting portion 22, the fixing lever 32, the shutter 24, and the shutter 34 are integrated and able to slide as a united one. With this state, a user is to slide the integrated one leftward. As a result it shifts to a positioning as shown in FIG. 11, and the communicating passage 23 and the communicating passage 33 become passable to each other through the communicating holes 26 and the communicating holes 37. This state corresponds to a passable state shown in FIG. 2. That is, nowhere of a toner sending route is opened to the external at any stages of attaching operation of cartridges. Furthermore, while the state of FIG. 11 is kept, either cartridge cannot be detached from the main body due to reasons described hereafter. It is to be noted, each cartridge can be detached in accordance with reverse order of attaching each cartridge as described above.

Figure 12:
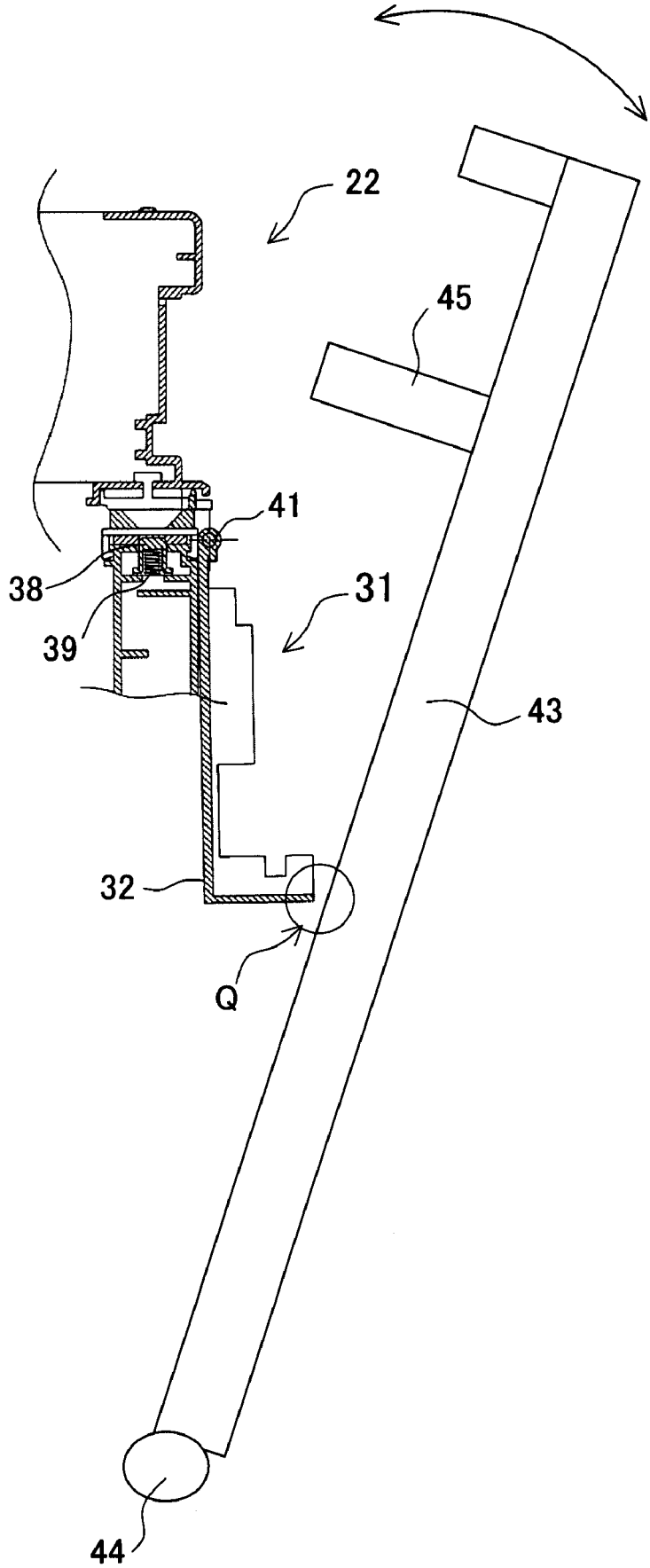
FIG. 12 is a cross sectional view showing relation of the connecting portion and a movable cover.
Figure 13:
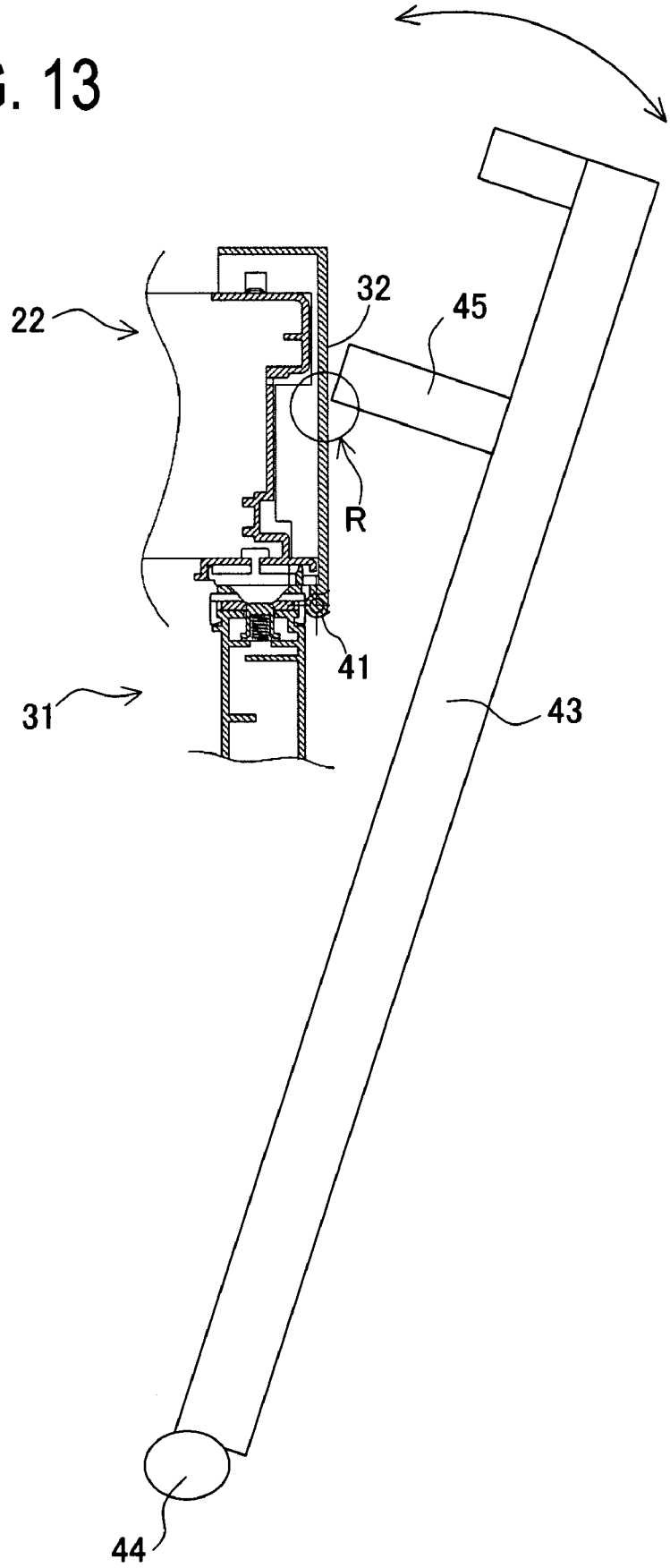
FIG. 13 is a cross sectional view showing relation of the connecting portion and the movable cover.

The color printer 10 directed to the first embodiment has a movable cover 43 at its front side in FIG. 1 (see FIG. 12 and FIG. 13). When each cartridge is attached or detached, the movable cover 43 is opened. The color printer 10 is not allowed to start operation not until the movable cover 43 is properly closed.

As shown in FIG. 12 and FIG. 13, the movable cover 43 of the color printer 10 has a rotation shaft 44 and is pivotally opened and closed as indicated with arrows. The FIGS. 12 and 13 show states viewed from left side of FIG. 1. The rotation shaft 44 is provided at a position slightly below the position where the toner cartridge 11 and the process cartridge 12 are attached together. The movable cover 43 is opened by making a portion upper of the rotation shaft 44 fallen down frontward for FIG. 1 (rightward in FIG. 12). When the movable cover 43 is opened, a user can touch the attachment portion of the toner cartridge 11 and the process cartridge 12.

FIG. 12, for example, shows a state that both of the cartridges are just inserted at their respective attachment places but the fixing lever 32 is kept down yet. If the movable cover 43 is to be closed under this situation, the movable cover 43 gets an intervention of the fixing lever 32 at a position indicated as circle Q. That is, the fixing lever 32 and an inner face of the movable cover 43 come to contact, so the movable cover 43 cannot be closed properly. The cartridges are in the state shown in FIG. 8 now.

Figure 14:
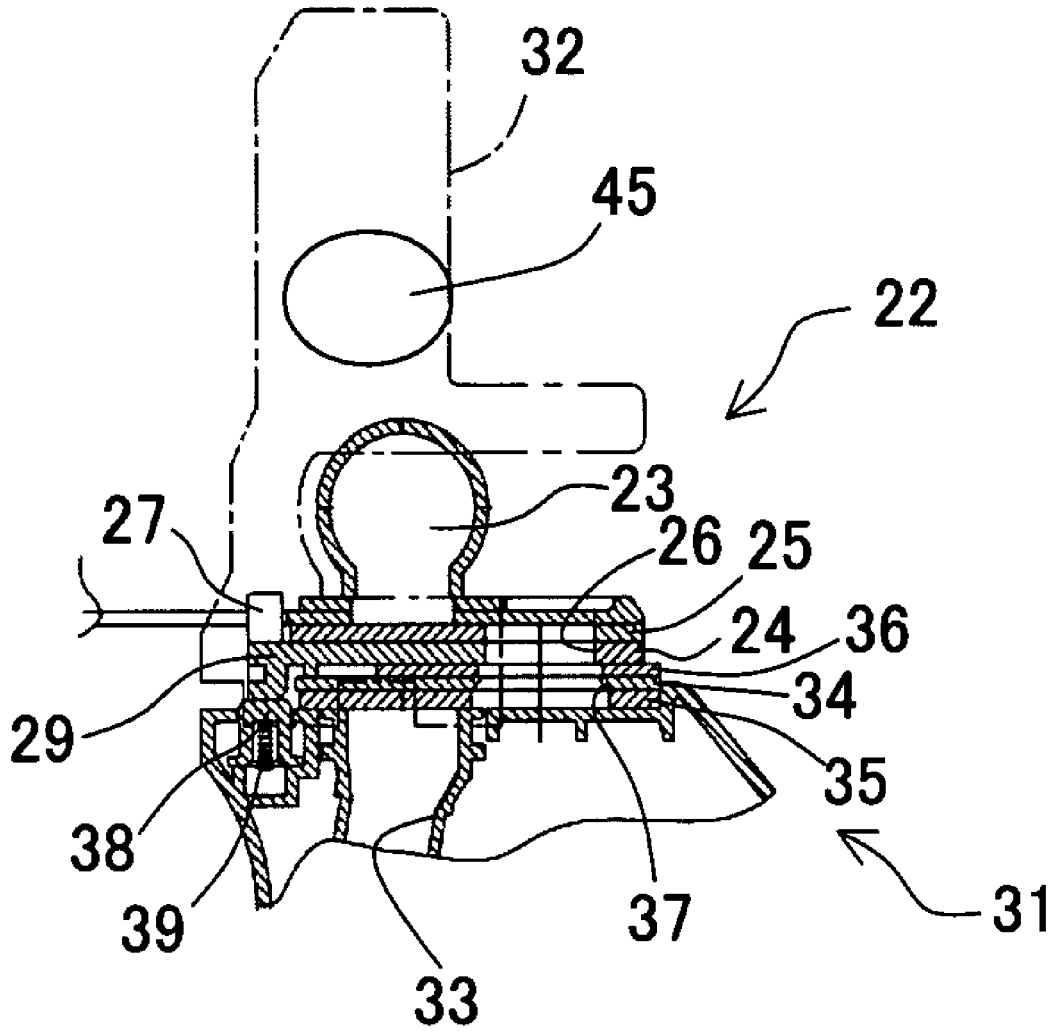
FIG. 14 is a cross sectional view showing relation of the connecting portion and the movable cover.
Figure 15:
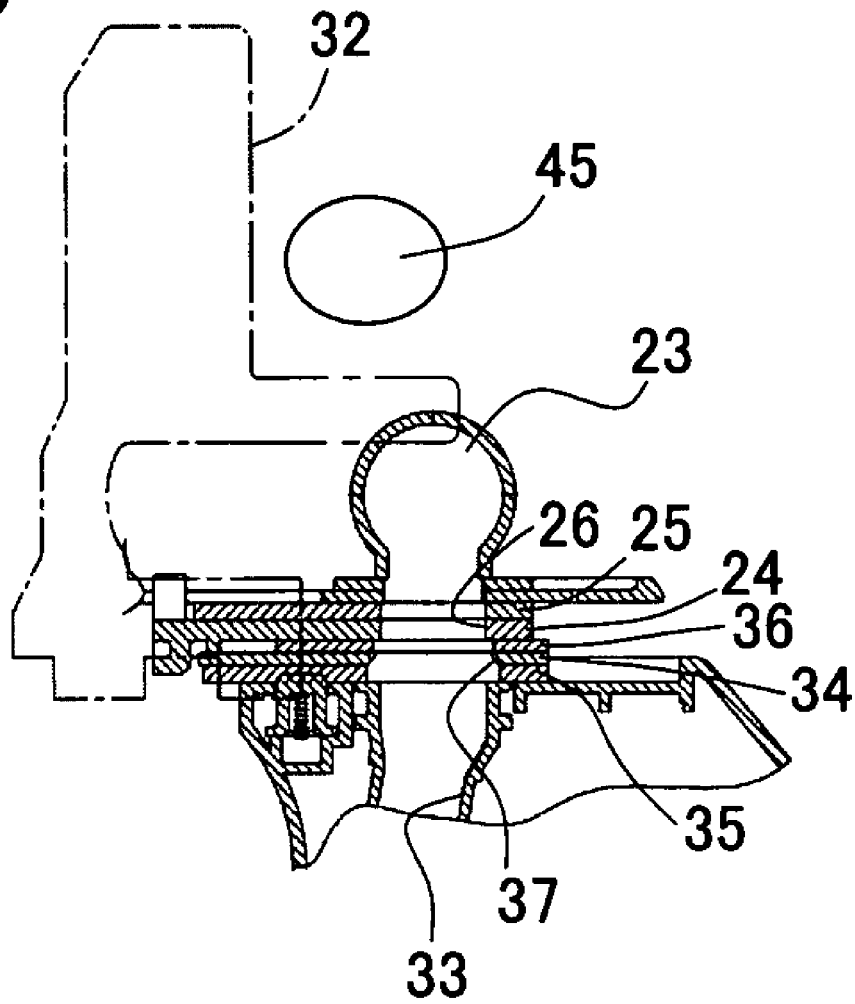
FIG. 15 is a cross sectional view showing relation of the connecting portion and the movable cover.

As shown in FIGS. 12 and 13, a boss 45 is provided inside of the movable cover 43. Therefore, when a user tries to close the movable cover 43 on condition that the fixing lever 32 is just lifted up but not slid, the movable cover 43 gets an intervention of the boss 45 at a position indicated as circle R, as shown in FIG. 13. That is, the boss 45 and the fixing lever 32 come to contact. The cartridges are in the state shown in FIG. 9 now. That is, as shown in FIG. 14, position of the boss 45 and that of the fixing lever 32 overlap when this state is viewed at a side same as FIG. 10. It is to be noted that there are provided four bosses 45 at equivalent positions for respective fixing levers 32 of the cartridges of four colors.

After the fixing lever 32 is slid together with the shutters 24 and 34, it shifts to a state that the boss 45 does not get contact with the fixing lever 32. That is, until all of the cartridges are thoroughly attached, the movable cover 43 cannot be closed properly. In other words, in this embodiment, the movable cover 43 cannot be closed in the middle of attaching each cartridge. Therefore, even an unaccustomed user can recognize incomplete attachment of a cartridge easily. Accordingly, there is no fear of forgetting to open shutters.

Figure 16:
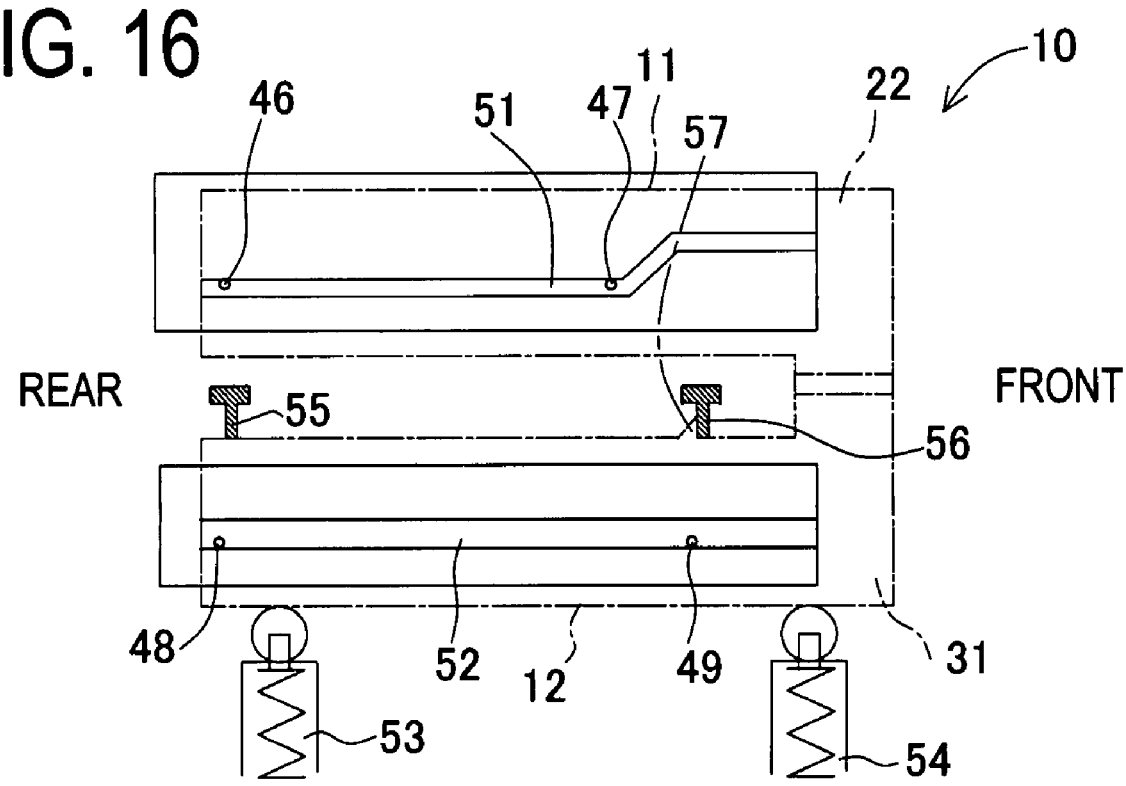
FIG. 16 is a view for illustrating cartridge-attachment route on main body of the color printer.

Next, there will be described a route that the toner cartridge 11 and the process cartridge 12 are to be moved for attaching to and detaching from the main body of the color printer 10. Inside of the main body of the color printer 10, as shown in FIG. 16, there are provided rails 51 for guiding the toner cartridge 11, and rails 52 for guiding the process cartridge 12. Two rails 51 and two rails 52 are respectively provided along insertion position of both side faces with respect to each cartridge. FIG. 16 shows a simplified state of FIG. 1 viewed from its left side. That is, right side and left side in FIG. 16 correspond to front side and rear side of the printer 10, respectively.

Protrusions 46 and 47 to get engaged with the rails 51 are formed on both side faces of the toner cartridge 11. Furthermore, protrusions 48 and 49 to get engaged with the rails 52 are formed on both side faces of the process cartridge 12. Both the rails 51 and the rails 52 are formed wider in comparison with width of the protrusions 46 through 49. The rails 51 are formed slightly wider while the rails 52 are formed significantly wider. Therefore, in FIG. 16, the toner cartridge 11 and the process cartridge 12 can be moved in up-and-down direction to some extent.

Firstly, there will be described insertion of a toner cartridge 11. The toner cartridge 11 is inserted from right to left in FIG. 16. The rails 51 run at slightly upper portion at right side (front side), then bend downward in the middle and run at slightly lower portion at left side (rear side). Therefore, of the toner cartridge 11 in the middle of being inserted, the protrusions 47 are held more upper in comparison with the protrusions 46. That is, the toner cartridge 11 is inserted with its connecting portion 22 tilted slightly upward. Therefore, even if a process cartridge 12 is inserted in advance, the toner cartridge 11 can be inserted without making the connecting portion 22 contact with a connecting portion 31 of the process cartridge 12 in the middle of insertion. Once the insertion is completed, the toner cartridge 11 is held almost horizontally because the protrusions 46 and 47 are positioned on horizontal portions of the rails 51.

Next, there will be described insertion of a process cartridge 12. The process cartridge 12 is also inserted from right to left in FIG. 16. Since the rails 52 are formed widely on the hole, the process cartridge 12 can be moved in up-and-down direction slightly in the middle of being inserted. Furthermore, in the main body of the color printer 10, push-up members 53 and 54 with elastic members inside and fixing members 55 and 56 are provided below and above of a position where the process cartridge 12 is to be positioned, respectively. The push-up members 53 and 54 are provided below of the position and urge the process cartridge 12 upward. On the other hand, the fixing members 55 and 56 are provided above of the position. Position of the process cartridge 12 pushed up by the push-up members 53 and 54 is determined by getting contact with the fixing members 55 and 56.

A protrusion 57 is formed at more rear side than the connecting portion 31 on an upper face of the process cartridge 12. Therefore, when a user tries to insert the process cartridge 12 straight along the rails 52, the protrusion 57 and a fixing member 56 get in contact with each other in the middle. So, a user tries to push slightly down the process cartridge 12. Thereby, the push-up members 53 and 54 are pushed down and the protrusion 57 can avoid getting in contact with the fixing members 56. That is, widths of the rails 52 are wide enough to avoid the contact. Therefore, even if the toner cartridge 11 is inserted in advance, a user can insert the process cartridge 12 without making the connecting portion 31 contact with the connecting portion 22 of the toner cartridge 11 in the middle of insertion. Once the protrusion 57 passes the fixing member 56, the process cartridge 12 gets back to a position of being pushed up by the push-up members 53 and 54.

Furthermore, similar to the attachment operation, when the toner cartridge 11 and the process cartridge 12 are detached from the main body of the color printer 10, the connecting portion 31 of the process cartridge 12 and the connecting portion 22 of the toner cartridge 11 are prevented from touching each other. That is, when the toner cartridge 11 is detached, the connecting portion 22 is tilted slightly upward by the rails 51. Furthermore, when the process cartridge 12 is detached, the connecting portion 31 is pushed down once so that the protrusion 57 can evade the fixing member 56. Therefore, when either cartridge is detached, the cartridge can be detached without getting in contact with a connecting portion of the other unit. This mechanism prevents the connecting portions 31 of the process cartridge 12 and the connecting portion 22 of the toner cartridge 11 from rubbing with each other at the time of being attached and detached.

Furthermore, the inserted process cartridge 12 is pushed up by the push-up members 53 and 54 on condition that the protrusion 57 is located at rear side of the fixing member 56. Therefore, the process cartridge 12 cannot be pulled out straight rightward in FIG. 16. This is because a front face of the protrusion 57 gets in contact with a rear face of the fixing member 56. Furthermore, when the toner cartridge 11 and the process cartridge 12 are correctly attached and connected with each other with the fixing lever 32, those cartridges cannot be pushed down together. That is, the protrusions 46 and 47 are regulated by the rails 51. Accordingly, cartridges are not detached carelessly by an unaccustomed user.

Relating to the color printer 10, it is preferable that positioning of the process cartridge 12 is determined with comparatively accurate degree with reference to the main body so as to avoid misregistration of image at the time of forming an image. On the other hand, positioning of the toner cartridge 11 may be determined with reference to the process cartridge 12. This means the toner cartridge 11 has a touch of free-movement range with reference to the color printer 10 when inserted. After connected to the process cartridge 12 by the fixing lever 32, positioning of the toner cartridge 11 is determined and finally fixed.

As described, according to the color printer 10 of the present embodiment, the shutter 24 and the shutter 34 are arranged on the toner cartridge 11 and the process cartridge 12, respectively. Therefore, when those cartridges are not attached yet, toner leakage never occurs to both of them. Furthermore, when they are inserted in the main body, the shutter 24 and the shutter 34 are moved together as an integrated one by the fixing lever 32. Therefore, it never occurs that either cartridge gets displaced or one of the shutters opens in the middle of attachment. Even though attachment is redone, the cartridges cannot be detached from each other before the shutters 24 and 34 are thoroughly closed. Furthermore, the removable cover 43 cannot be closed while cartridges have not been attached thoroughly. The color printer 10 achieves the following points that toner leakage from both a toner housing portion and process portion is prevented and even an unaccustomed user can surely attach each cartridge without making surrounding dirty.

Second Embodiment

Next, a second embodiment will be described in detail with reference to the accompanying drawings. In the second embodiment, a cylindrical shutter is additionally provided on the toner cartridge 11 of the first embodiment and the cylindrical shutter can be opened and closed together with other shutters. As to composing members equivalent to the first embodiment, same numerals are assigned to them and descriptions on them will be omitted.

Figure 17:
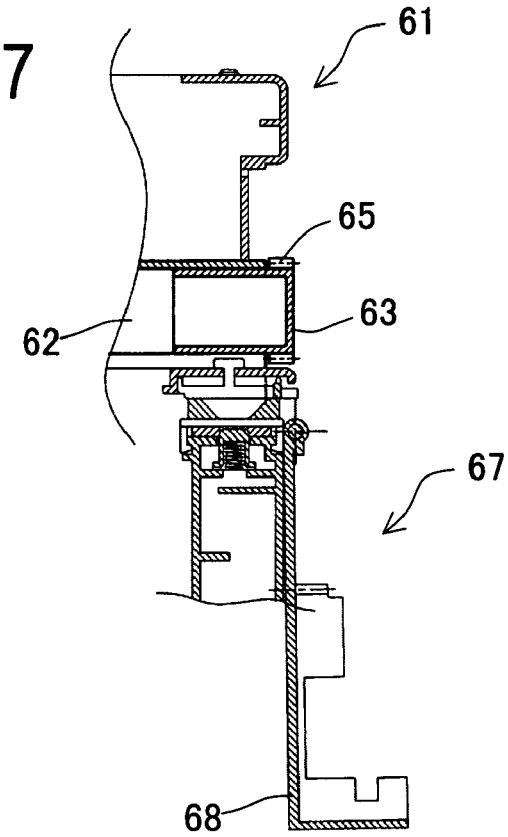
FIG. 17 is a cross sectional view showing a connecting portion of a toner cartridge and a process cartridge directed to a second embodiment.
Figure 18:
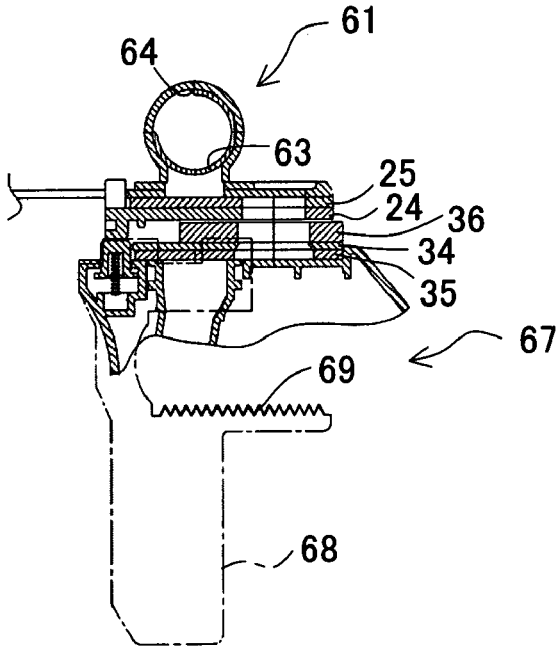
FIG. 18 is a cross sectional view showing the connecting portion of the toner cartridge and the process cartridge directed to the second embodiment.

Relating to a color printer directed to the second embodiment, as shown in FIG. 17 and FIG. 18, a cylindrical shutter 63 is provided on a communicating passage 62 of its toner cartridge 61. The cylindrical shutter 63 is a cylindrical member and a communicating hole 64 is formed on a part of it. The cylindrical shutter 63 is fitted in an inner face of the communicating passage 62 rotatably. Furthermore, in FIG. 17, a right end portion of the cylindrical shutter 63 is sealed and a gear 65 is formed at the periphery thereon. The gear 65 is provided protruding more rightward than the communicating passage 62 in FIG. 17. In the present embodiment, a rack portion 69 is provided on a fixing lever 68 of a process cartridge 66. FIG. 17 and FIG. 18 depict a situation that cartridges 61 and 66 are inserted in the main body but the fixing lever 68 is not lifted yet.

Figure 19:
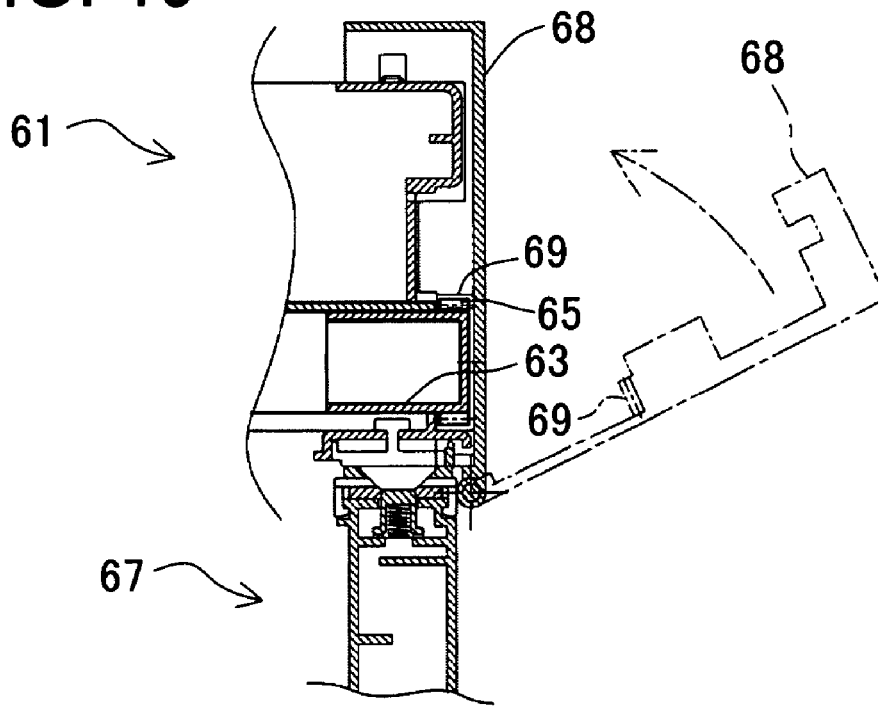
FIG. 19 is a cross sectional view showing the connecting portion of the toner cartridge and the process cartridge directed to the second embodiment.
Figure 20:
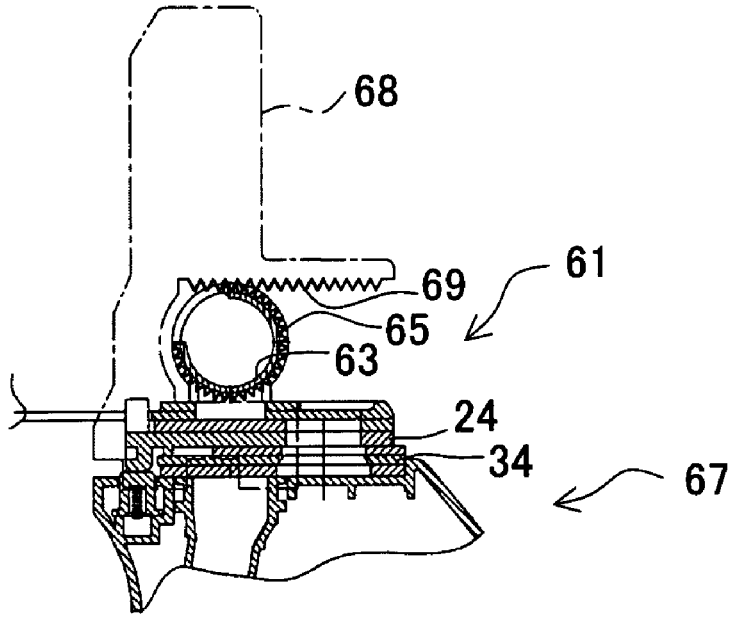
FIG. 20 is a cross sectional view showing the connecting portion of the toner cartridge and the process cartridge directed to the second embodiment.
Figure 21:
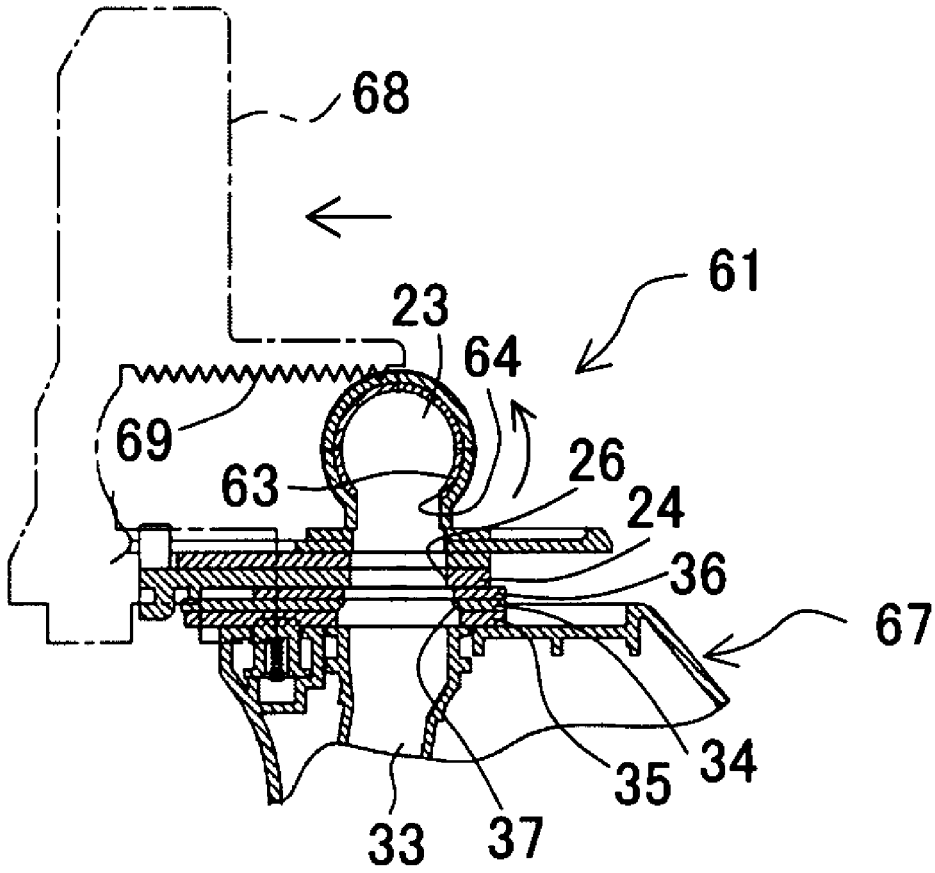
FIG. 21 is a cross sectional view showing the connecting portion of the toner cartridge and the process cartridge directed to the second embodiment.

After the fixing lever 68 is lifted, the gear 65 of the cylindrical shutter 63 and the rack portion 69 of the fixing lever 68 get engaged with each other, as shown in FIG. 19 and FIG. 20. With this state, the cylindrical shutter 63, the shutter 24 and the shutter 34 are closed. Similar to the first embodiment, the fixing lever 68 is moved leftward, in FIG. 20. Then, it shifts to a state as shown in FIG. 21. That is, the shutters 24 and 34 are moved leftward together with the fixing lever 68, in FIG. 21. At the same time, the gear 65 is rotated by the rack portion 69 and the cylindrical shutter 63 is rotated thereby. Then, the communicating hole 64 is designed to face down when the rack portion 69 finishes moving. Accordingly, the communicating passage 62 of the toner cartridge 61 and the communicating passage 63 of the process cartridge 66 become passable to each other through a communicating hole 64 of the cylindrical shutter 63, a communicating holes 26 of the shutter 24, and a communicating hole 37 of the shutter 34.

As described, the second embodiment realizes a color printer capable of preventing toner leakage from both a toner housing portion and a process portion with better degree than the first embodiment, and enabling even an unaccustomed user to attach various units without making surroundings dirty.

Third Embodiment

A third embodiment will be described in detail with reference to the accompanying drawings. In the third embodiment, shutter structure of the toner cartridge 11 and the process cartridge 12 directed to the first embodiment is slightly changed. In the present embodiment, a slide-type shutter is not employed. As to composing members equivalent to the first and second embodiments, same numerals are assigned to them and descriptions on them will be omitted.

Figure 22:
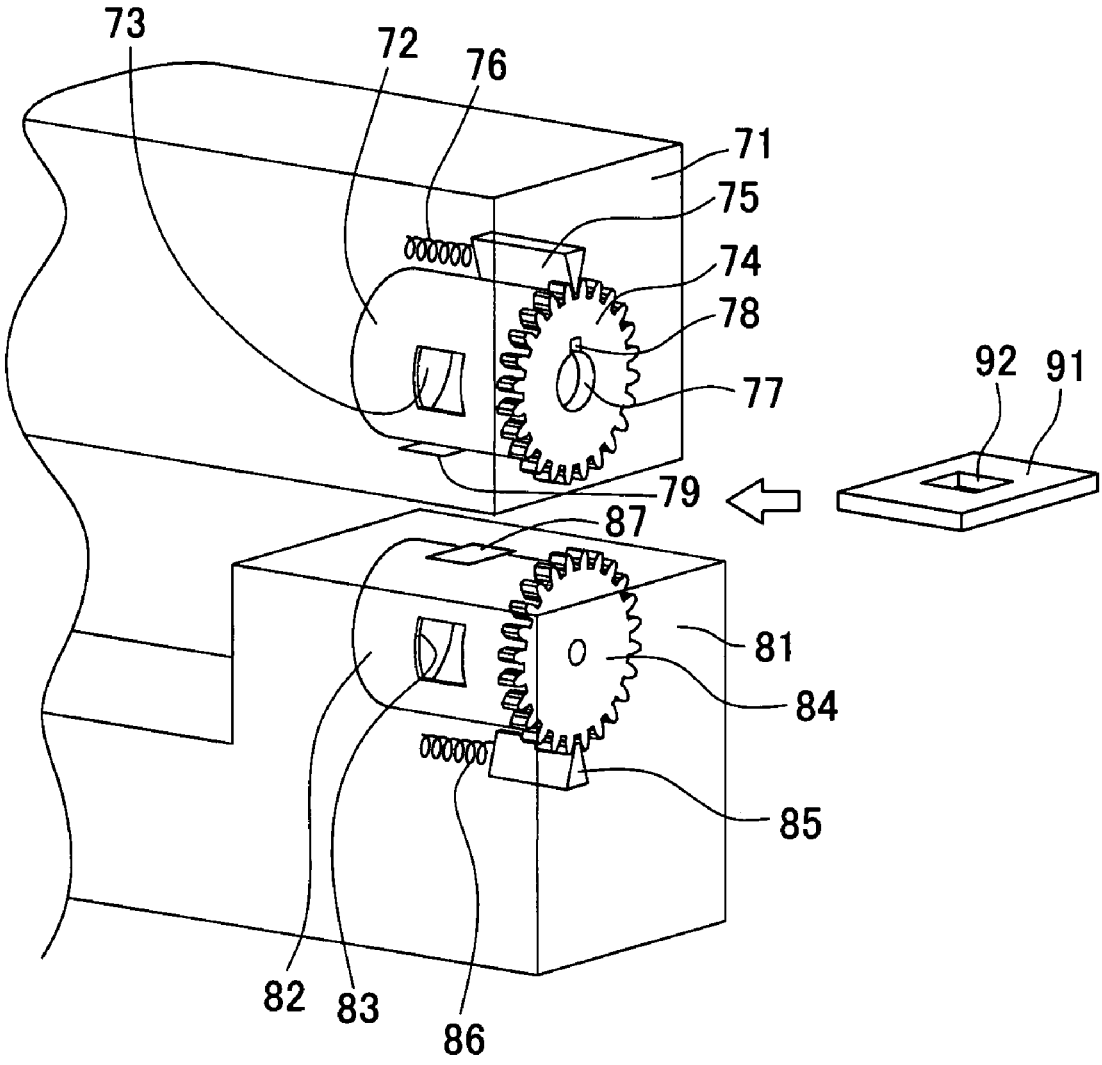
FIG. 22 is a transparent view showing a connecting portion of a toner cartridge and a process cartridge directed to a third embodiment.

Relating to a color printer directed to the third embodiment, as shown in FIG. 22, a cylindrical shutter 72 is provided on a communicating passage of the toner cartridge 71. A communicating hole 73 is formed on the cylindrical shutter 72. Furthermore, a gear 74 is formed on one end face of the cylindrical shutter 72. A part of the gear 74 protrudes downward from a lower face of a case of the toner cartridge 71, in FIG. 22. The toner cartridge 71 has a stopper 75 which is to get engaged with one of teeth of the gear 74. The stopper 75 is urged frontward, at right side in FIG. 22, by a spring 76.

In the center of the gear 74, a key-equipped hole 77 is formed. Under the state as shown in FIG. 22, a key 78 is located at upside. Furthermore, a through hole 79 is formed on a lower face of the case of the toner cartridge 71. When the cylindrical shutter 72 is rotated, the communicating hole 73 and the through hole 79 can face to each other. Positioning of those holes shown in FIG. 22 are that of natural state, i.e., what they are before the toner cartridge 71 is attached to a process cartridge 81. With the state as shown in FIG. 22, the communicating hole 73 and the through hole 79 do not face to each other, so the communicating hole 73 is closed in this state. Also, since rotation of the gear 74 is stopped by the stopper 75 at this state, toner leakage does not occur.

As shown in FIG. 22, a cylindrical shutter 82 is provided on a communicating passage of a process cartridge 81. A communicating hole 83 is formed on the cylindrical shutter 82. Furthermore, a gear 84 is formed on one end face of the cylindrical shutter 82. A part of the gear 84 protrudes upward from an upper face of a case of the process cartridge 81, in FIG. 22. The process cartridge 81 has a stopper 85 which is to get engaged with one of teeth of the gear 84. The stopper 85 is urged frontward, at right side in FIG. 22, by a spring 86.

Figure 23:
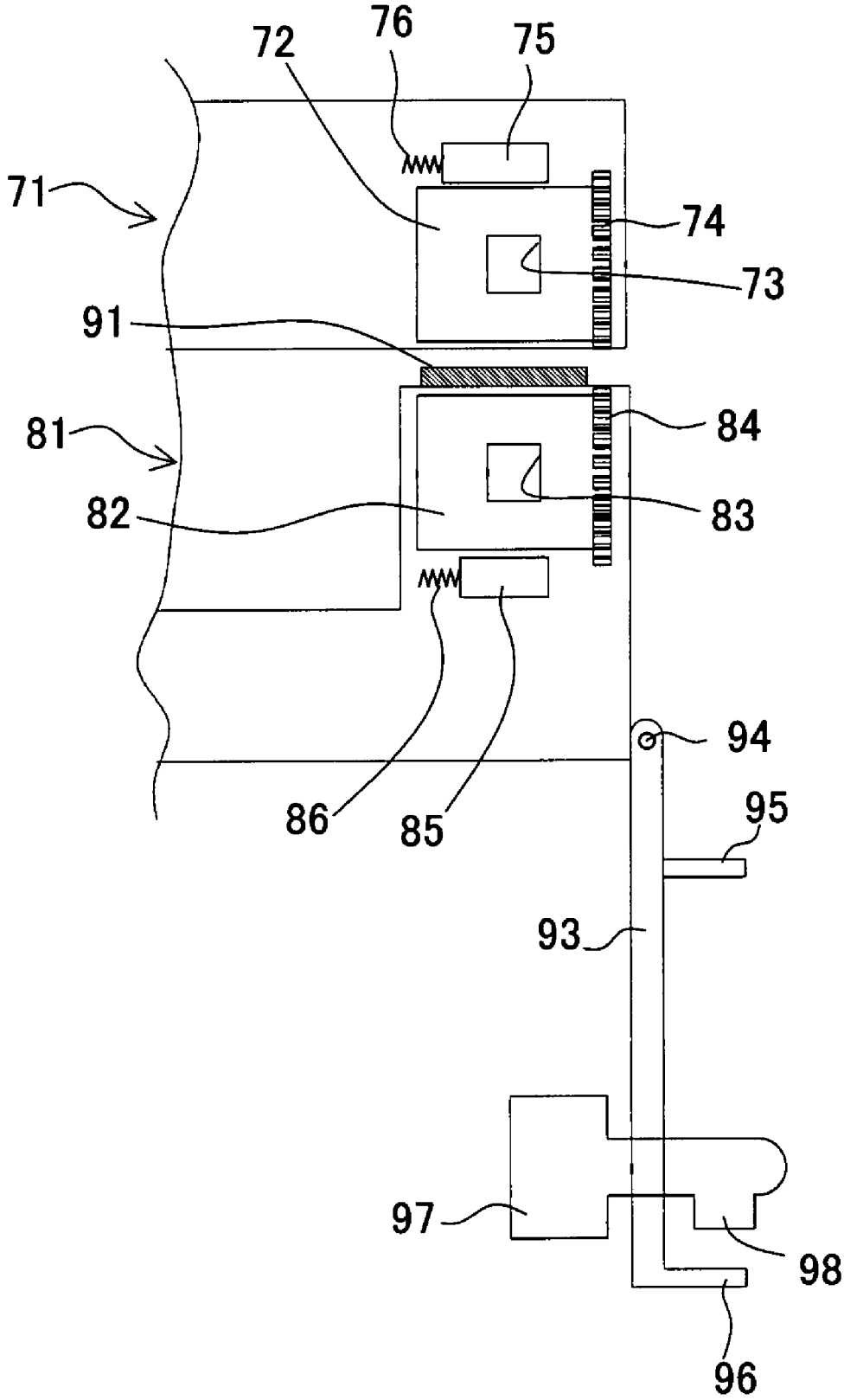
FIG. 23 is a view for illustrating the connecting portion of the toner cartridge and the process cartridge directed to the third embodiment.

Furthermore, a through hole 87 is formed on an upper face of the case of the process cartridge 81. When the cylindrical shutter 82 is rotated, the communicating hole 83 and the through hole 87 can face to each other. Positioning of those holes shown in FIG. 22 are that of natural state, i.e., what they are before the process cartridge 81 is attached to the toner cartridge 71. With the state as shown in FIG. 22, the communicating hole 83 and the through hole 87 do not face to each other, so the communicating hole 83 is closed in this state. Also, since rotation of the gear 84 is stopped by the stopper 85, toner leakage does not occur. Furthermore, as shown in FIG. 22 and FIG. 23, a packing 91 is provided between the toner cartridge 71 and the process cartridge 81. On the packing 91, there is formed a through hole 92 which is almost same as the through holes 79 and 87. The packing 91 is to be adhered to a lower face of the toner cartridge 71 or to an upper face of the process cartridge 81.

Figure 24:
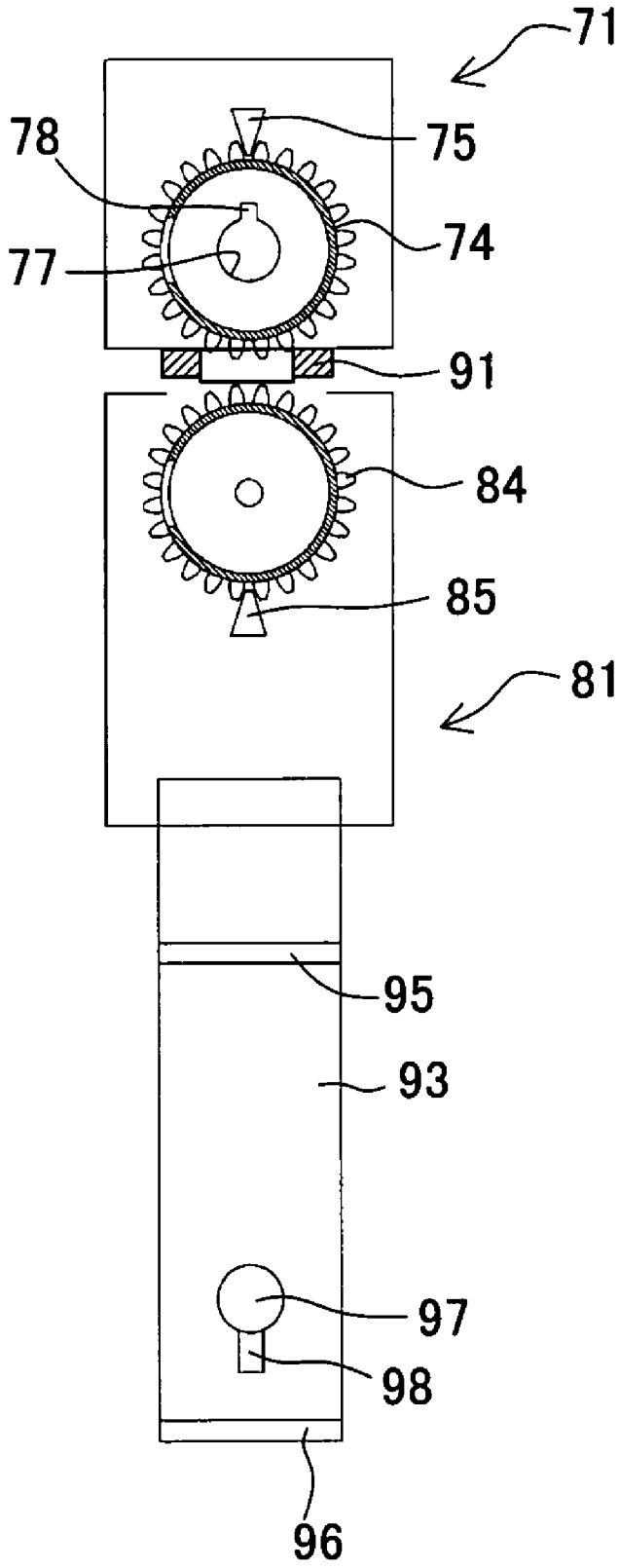
FIG. 24 is a view for illustrating the connecting portion of the toner cartridge and the process cartridge directed to the third embodiment.

As shown in FIG. 23 and FIG. 24, a fixing lever 93 is provided on the process cartridge 81. FIG. 24 corresponds to a state of FIG. 23 viewed from its right side. The fixing lever 93 is rotatable around the center of a rotation axis 94. Out of the faces of the fixing lever 93, convex portions 95 and 96 are formed on a face which becomes inner when the cartridges 71 and 81 are attached together. Furthermore, a rotation lever 97 is rotatably attached to the fixing lever 93. Rotation axis of the rotation lever 97 is arranged in horizontal-depth direction in FIG. 23. A key portion 98 is formed on the rotation lever 97.

Figure 25:
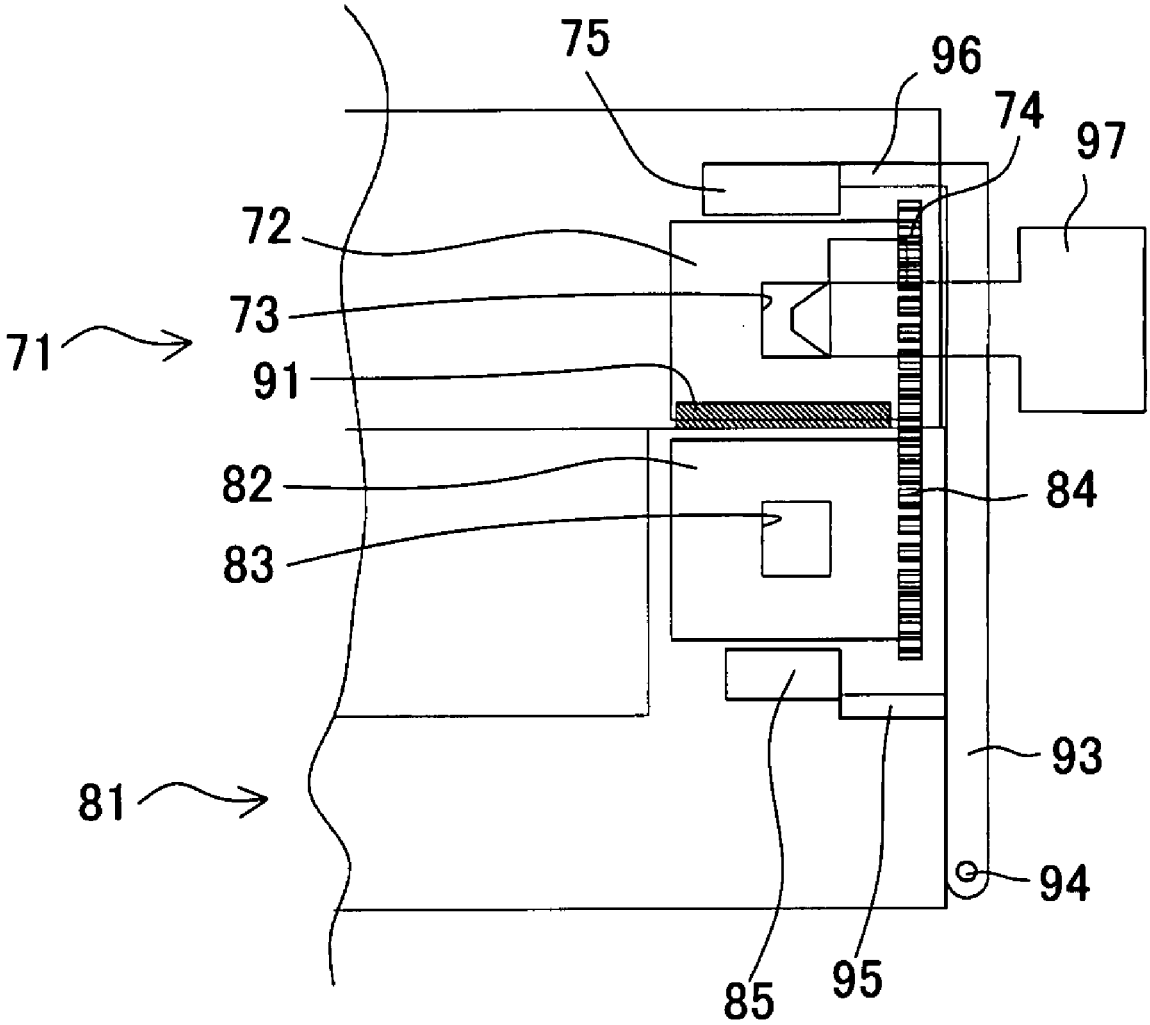
FIG. 25 is a view for illustrating the connecting portion of the toner cartridge and the process cartridge directed to the third embodiment.

Next, there will be described operations to attach the toner cartridge 71 and the process cartridge 81 to the color printer of the present embodiment. Firstly, as shown in FIG. 23 and FIG. 24, both the cartridges 71 and 81 are inserted into the main body of the color printer. At this stage, there is a slight distance between the two cartridges 71, 81. Next, as shown in FIG. 25, the fixing lever 93 is rotated around the center of the rotation shaft 94 to be pushed into the cartridges 71 and 81. The packing 91 is compressed by the fixing lever 93 and the cartridges 71 and 81 are made closer.

Furthermore, the stopper 85 of the process cartridge 81 is pushed inward by the convex portion 95 of the fixing lever 93. Also, the stopper 75 of the toner cartridge 71 is pushed inward by the convex portion 96 of the fixing lever 93. The rotation lever 97 is inserted to the key-equipped hole 77. The key portion 98 of the rotation lever 97 is inserted into the key portion 78 of the key-equipped hole 77. Furthermore, the gear 74 and the gear 84 get engaged with each other at a portion where they respectively protrude from their cases. The through hole 79 of the toner cartridge 71 and the through hole 87 of the process cartridge 81 become passable through the through hole 92 of the packing 91.

Figure 26:
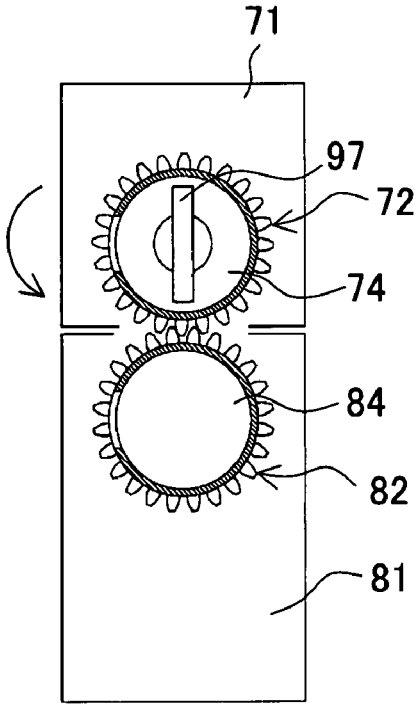
FIG. 26 is a view for illustrating the connecting portion of the toner cartridge and the process cartridge directed to the third embodiment.
Figure 27:
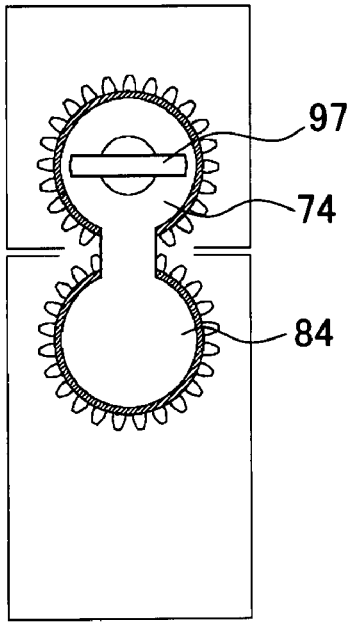
FIG. 27 is a view for illustrating the connecting portion of the toner cartridge and the process cartridge directed to the third embodiment.

FIG. 26 corresponds to FIG. 25 viewed from right direction. With the state of FIG. 26, the rotation lever 97 and the gear 74 get engaged with each other by the key portion 98. When the rotation lever 97 is rotated counterclockwise by about 90 degrees, as indicated with arrow in FIG. 26, the gear 74 is rotated together with the rotation lever 97 and the cylindrical shutter 72 of the toner cartridge 71 is rotated counterclockwise by about 90 degrees. At the same time, due to the engagement of the gears 74 and 84, the cylindrical shutter 82 of the process cartridge 81 is rotated clockwise by about 90 degrees. As a result, the communicating hole 73 of the cylindrical shutter 72 and the communicating hole 83 of the cylindrical shutter 82 become passable to each other through the through hole 79, the through hole 92 of the packing 91 and the through hole 87, as shown in FIG. 27.

Similar to the first embodiment, the third embodiment realizes a color printer capable of preventing toner leakage from both a toner housing portion and a process portion and enabling even an unaccustomed user to attach various units without making surroundings dirty.

Fourth Embodiment

Figure 28:
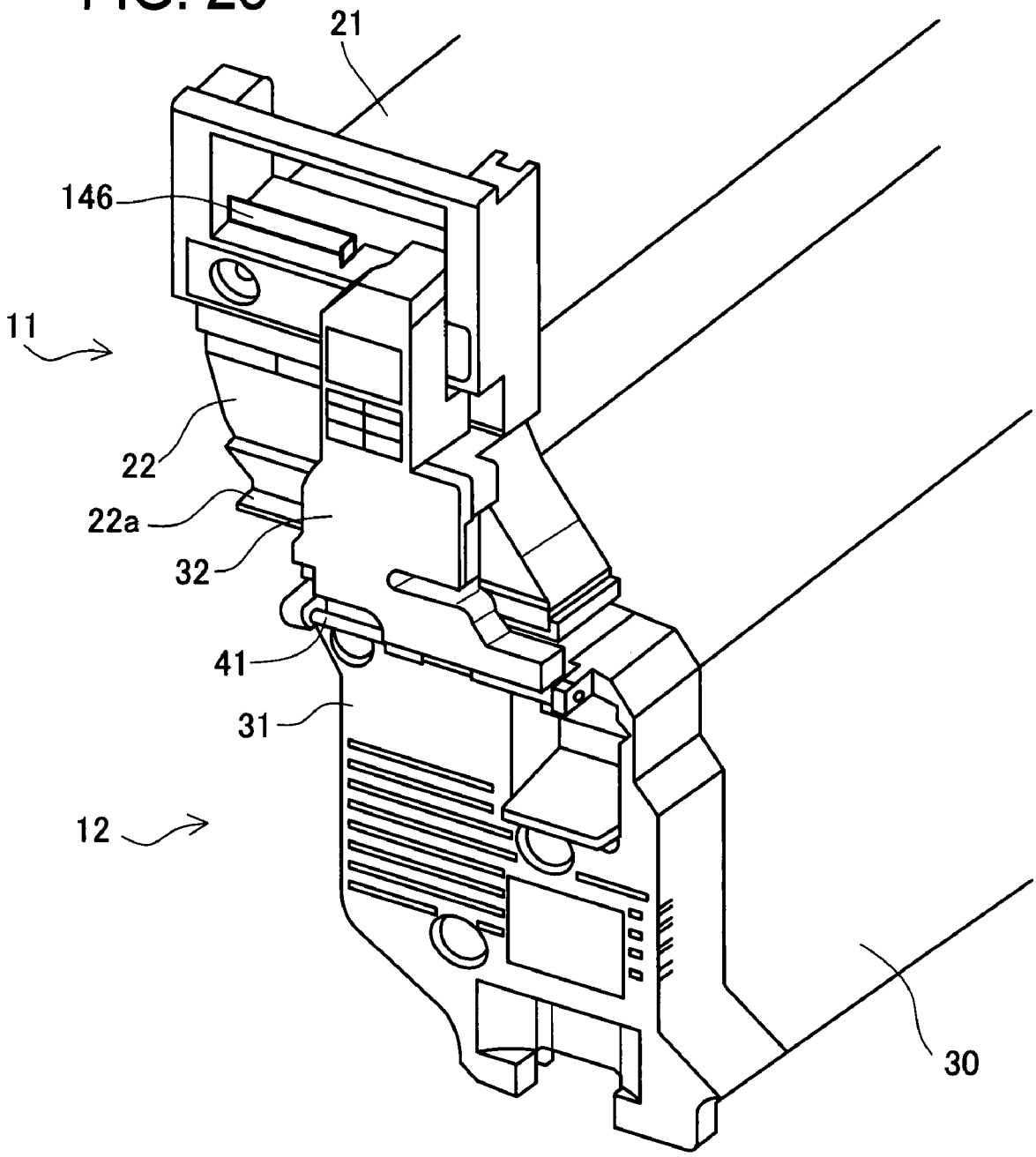
FIG. 28 is a perspective view showing a state that the toner cartridge and the process cartridge are attached to each other.

A fourth embodiment will be described in detail with reference to the accompanying drawings. As to composing members equivalent to the afore-mentioned embodiments, same numerals are assigned to them and descriptions on them will be omitted. FIG. 28 shows a state of a toner cartridge 11 and a process cartridge 12 directed to the fourth embodiment, corresponding to FIG. 1 viewed from diagonally right at front side.

As shown in FIG. 28, on the toner cartridge 11 of the present embodiment, there are provided a toner housing portion 21 and a connecting portion 22 at more front of the toner housing portion 21. On the process cartridge 12, there are provided a process portion 30 and a connecting portion 31 at more front of the process portion 30. The toner cartridge 11 and the process cartridge 12 are connected to each other by the connecting portions 22 and 31. It is to be noted that FIG. 28 shows a state that the two cartridges are disposed up and down to get connected to each other but not yet to be connected thoroughly.

Figure 29:
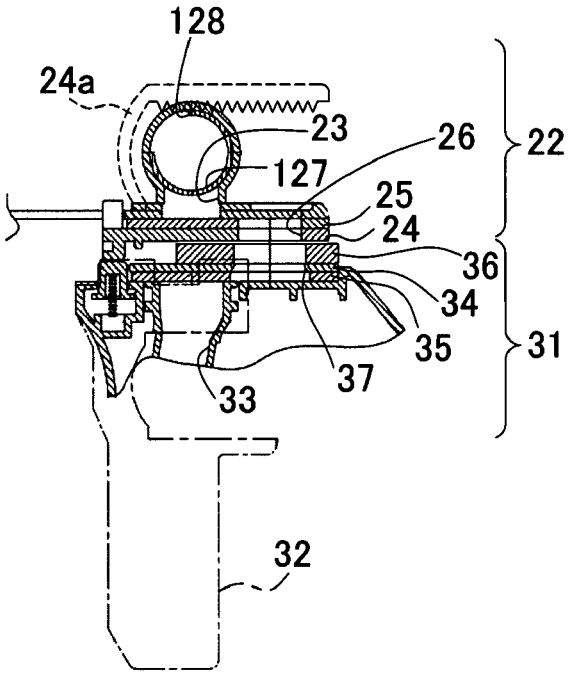
FIG. 29 is a cross sectional view showing the connecting portion of the toner cartridge and the process cartridge.
Figure 30:
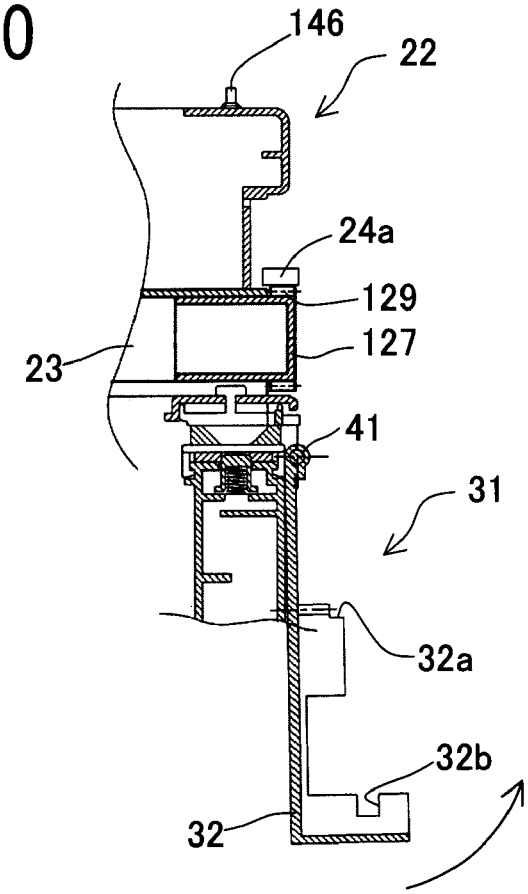
FIG. 30 is a cross sectional view showing the connecting portion of the toner cartridge and the process cartridge.

As shown in FIG. 29 and FIG. 30, various communicating passages for carrying toner are provided inside of a portion which connects the connecting portion 22 and the connecting portion 31. FIG. 29 is a cross sectional view of FIG. 28 viewed from left-front side thereof and FIG. 30 is a cross sectional view of FIG. 28 viewed from left-rear side thereof. Both of them show state of in-the-middle-of-connection. They also show only the connecting portion between the connecting portion 22 and the connecting portion 31.

As shown in FIG. 29 and FIG. 30, a communicating passage 23 for carrying toner of the toner housing portion 21 to the process cartridge 12 is formed inside of the connecting portion 22 of the toner cartridge 11. A shutter 24 which slides in left and right directions is provided on a lower face of the connecting portion 22. Furthermore, a seal member 25 which has some extent of elasticity is adhered to an upper face of the shutter 24. Two communicating holes 26 almost same in shape are formed at both the shutter 24 and the seal member 25, respectively, at positions where they meet each other in a vertical direction. Those communicating holes 26 are formed out substantially same as an opening portion (lower side in FIG. 29) of the communicating passage 23 in size and shape. Therefore, the communicating passage 23 and the communicating holes 26 become passable to each other by sliding the shutter 24 leftward in FIG. 29. FIG. 29 shows a state that the communicating passage 23 is closed by the shutter 24.

As shown in FIG. 29 and FIG. 30, the toner cartridge 11 has a cylindrical shutter 127 inside of the communicating passage 23. The cylindrical shutter 127 is a cylindrical member and a communicating hole 128 is formed on a part of it. The cylindrical shutter 127 is provided more upstream of toner flow than the shutter 24 and fitted with an inner surface of the communicating passage 23 rotatably. That is, the communicating hole 128 and the communicating hole 26 of the shutter 24 are met with each other by rotation of the cylindrical shutter 127, whereby toner passage is opened.

As shown in FIG. 30, a right end portion of the cylindrical shutter 127, in the figure, is sealed and a gear 129 is provided on the periphery of the cylindrical shutter 127. The gear 129 is provided protruding more rightward than the communicating passage 23 in FIG. 30. As shown in FIG. 29, a rack portion 24*a* which stems from the shutter 24 gets engaged with the gear 129. The rack portion 24*a* slides along with sliding movement of the shutter 24. This movement rotates the cylindrical shutter 127 via the gear 129. That is, arrangement direction and movement direction of the rack portion 24*a* are in parallel to sliding direction of the shutter 24. By sliding the shutter 24 leftward up to the position where the communicating passage 23 and the communicating hole 26 become passable to each other, the communicating hole 128 of the cylindrical shutter 127 and the communicating hole 26 of the shutter 24 come to meet with each other. Thereby, the shutter 24 and the cylindrical shutter 127 are set to their open positions or close positions at the same time.

On the other hand, a communicating passage 33 for receiving toner from the toner cartridge 11 is formed inside of the connecting portion 31 of the process cartridge 12, as shown in FIG. 29. A shutter 34 which slides in left and right direction is provided on an upper face of the connecting portion 31. Furthermore, a seal member 35 which has some extent of elasticity is adhered to a lower face of the shutter 34. Furthermore, a packing 36 which surpasses the seal member 35 in thickness and elasticity is adhered to the upper face of the shutter 34. The packing 36 may be adhered to the lower face of the shutter 24 of the toner cartridge 11.

Communicating holes 37 almost same in shape are provided on the shutter 34, the seal member 35, and the packing 36 respectively at a position where they meet one another vertically. Those communicating holes 37 are formed out substantially same as an opening portion (upper side in FIG. 29) of the communicating passage 33 in size and shape. Therefore, the communicating passage 33 and the communicating holes 37 become passable to each other by sliding the shutter 34 leftward in FIG. 29. FIG. 29 shows a state that the communicating passage 33 is closed by the shutter 34.

Furthermore, a fixing lever 32 is attached to a right face of the connecting portion 31 of the process cartridge 12, in FIG. 30. The fixing lever 32 is a plate-like member which rotates around the center of a lever supporting shaft 41. The lever supporting shaft 41 is arranged on an upper portion of the connecting portion 31. An engaging portion 32*a* and a groove 32*b* are formed on an inner face (right-side face in FIG. 30) of the fixing lever 32.

The fixing lever 32 is rotated counterclockwise, from bottom to top, by a user when both of the cartridges are attached. FIG. 28 shows a state that the fixing lever 32 is lifted upward and pushed to the toner cartridge 11. When the cartridges are disconnected, the fixing lever 32 is rotated from top to bottom, i.e., clockwise in FIG. 30. That is, the toner cartridge 11 and the process cartridge 12 are connected and disconnected by moving the fixing lever 32 upward or downward.

Figure 31:
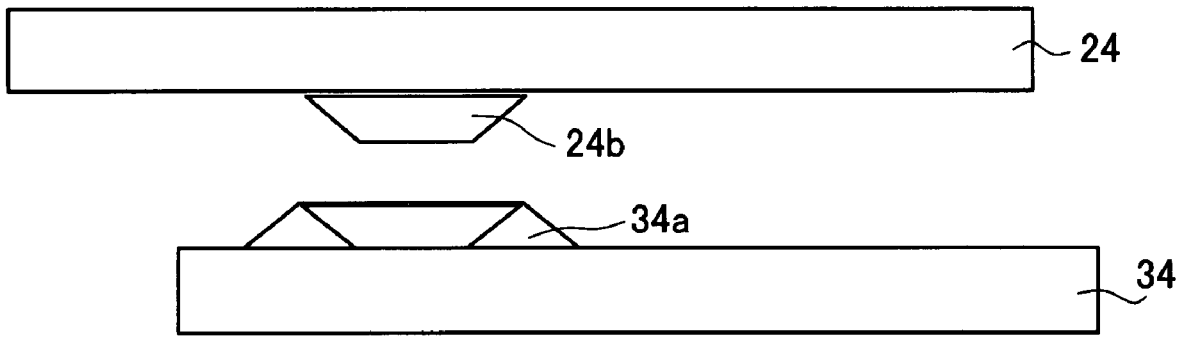
FIG. 31 is a cross sectional view showing connecting portion of two shutters.
Figure 32:
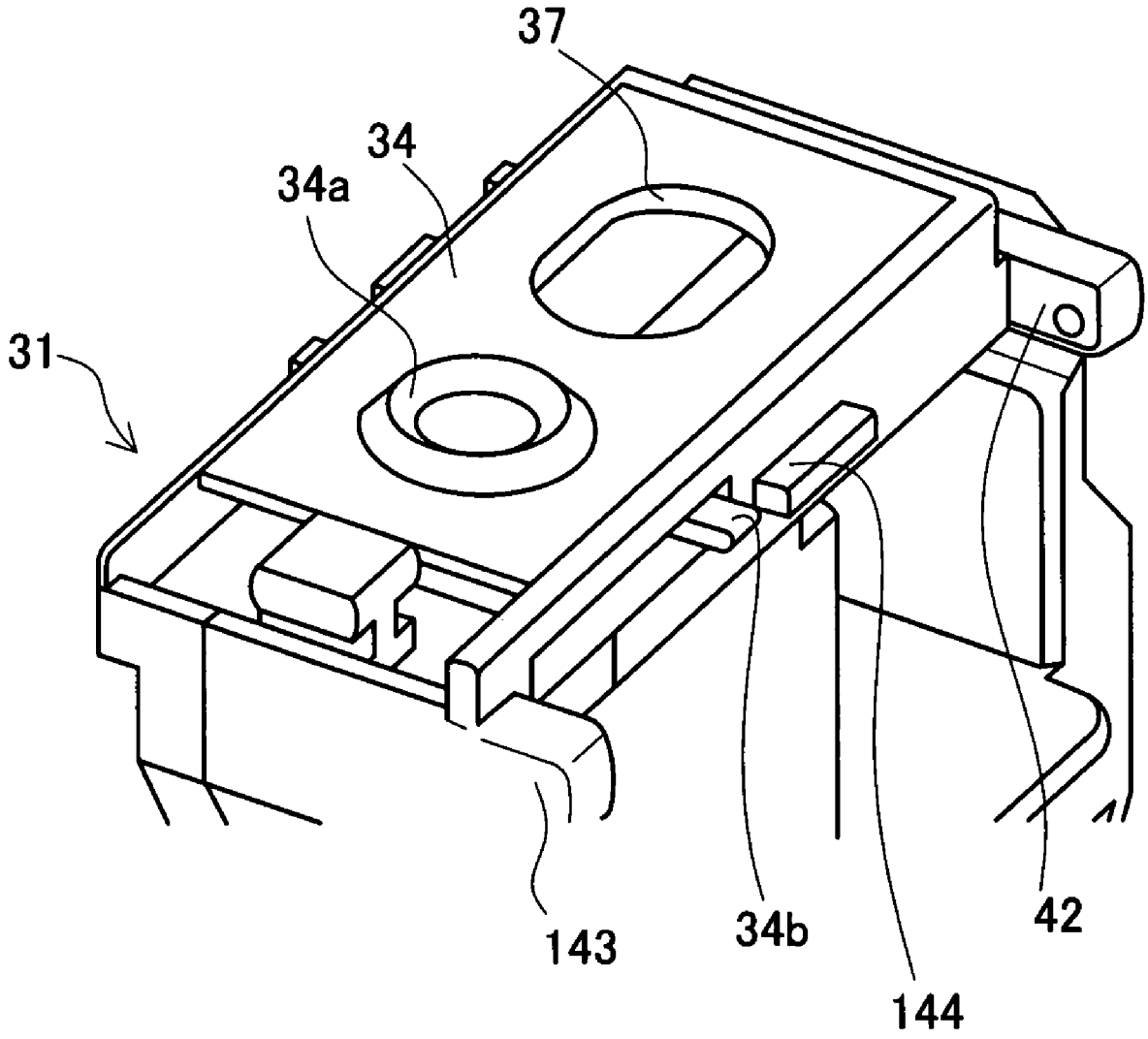
FIG. 32 is an outline view showing a shutter of the process unit.
Figure 33:
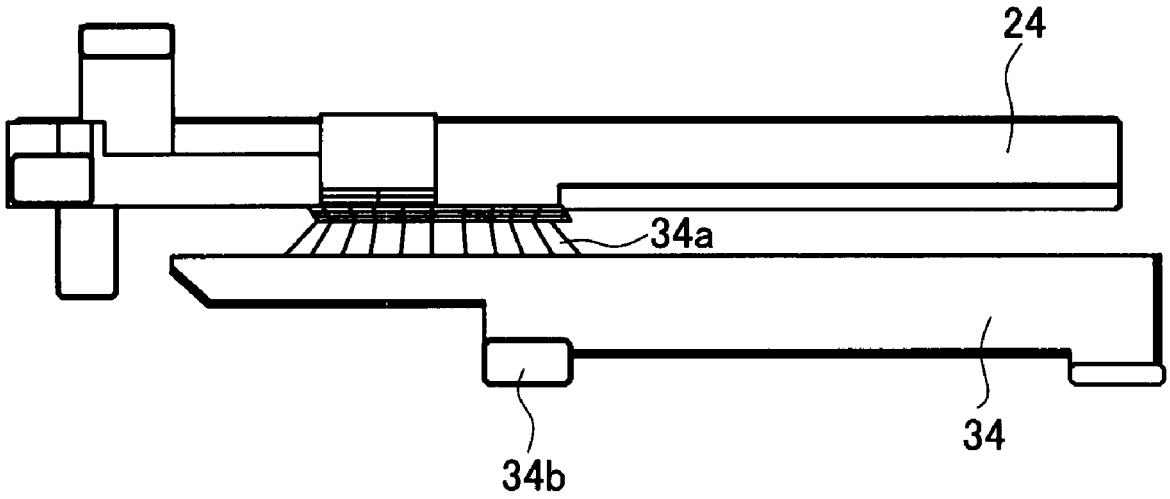
FIG. 33 is an outline view showing the connecting portion of the two shutters.

As shown in FIG. 31, a truncated cone shaped convex portion 24*b* protruding downward is formed on the lower face of the shutter 24 of the toner cartridge 11, off the communicating hole 26 thereon. Furthermore, as shown in FIG. 31 and FIG. 32, a receptor portion 34*a* is formed on the upper face of the shutter 34 of the process cartridge 12, off the communicating hole 37 thereon. Outline of the receptor portion 34*a* is truncated cone shaped whereas inner face of it is tapered. As shown in FIG. 33, it is designed such that the convex portion 24*b* fits in the receptor portion 34*a*. As shown in FIG. 32, a convex portion 34*b* penetrates a hole formed on a front face of the connecting portion 31 and long in a slide direction and protrudes rightward at front side in the figure.

It does not matter even though the toner cartridge 11 and the process cartridge 12 are set slightly dislocated from each other, when the fixing lever 32 is lifted. As long as a part of the convex portion 24*b* gets into the receptor portion 34*a* then, the two cartridges can come closer to each other at their center by pressing. Therefore, positioning of the shutter 24 and the shutter 34 is made properly by the receptor portion 34*a* and the convex portion 24*b*. Furthermore, when the shutters are thus positioned, the shutter 24 and the shutter 34 are set to their open positions or close positions at the same time.

Figure 34:
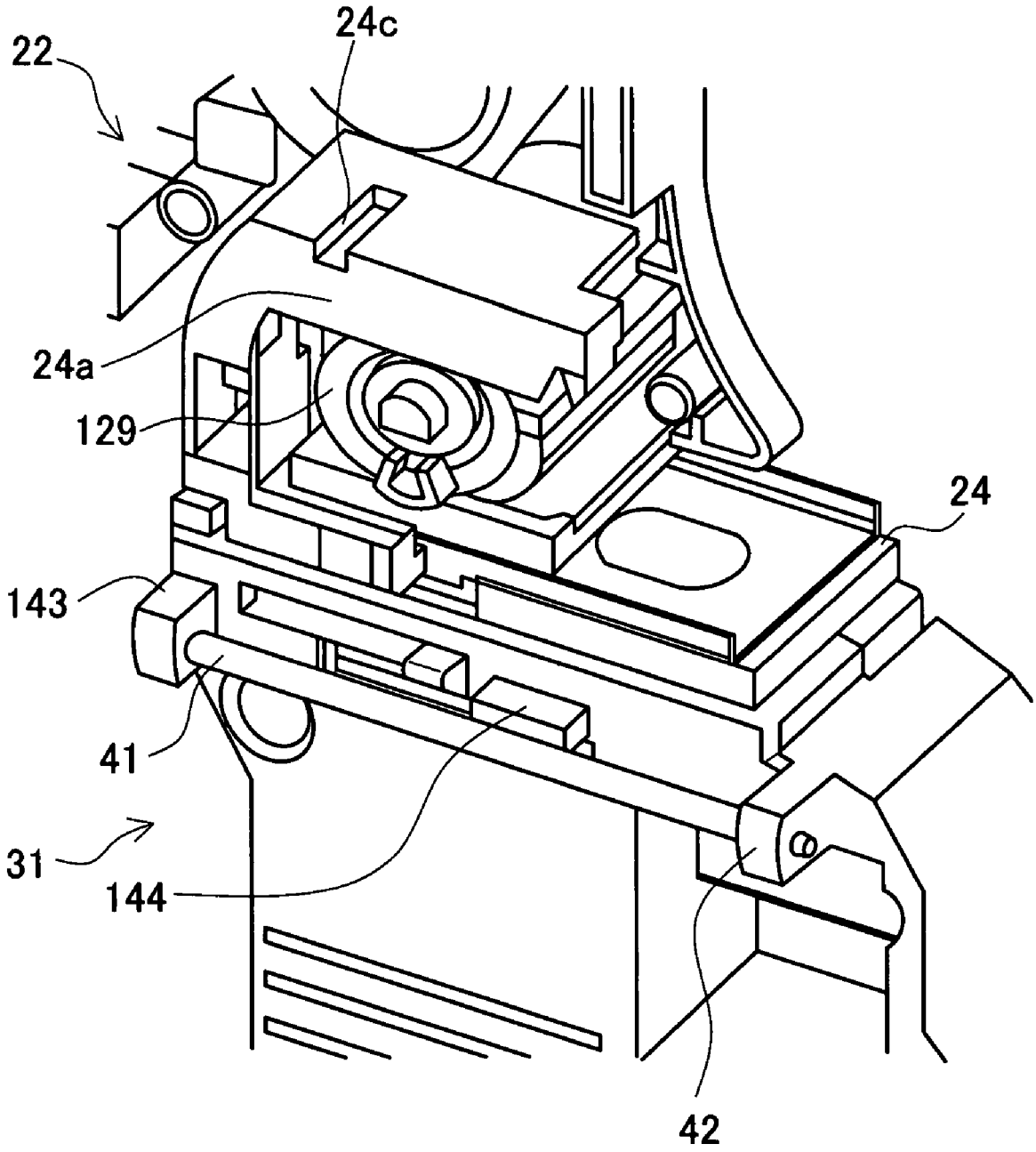
FIG. 34 is a perspective view showing the connecting portion of the toner cartridge and the process cartridge.
Figure 35:
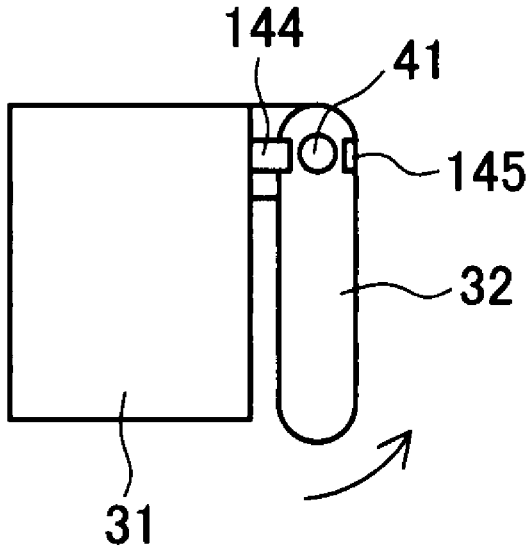
FIG. 35 is a schematic side view showing movement of a fixing lever.
Figure 36:
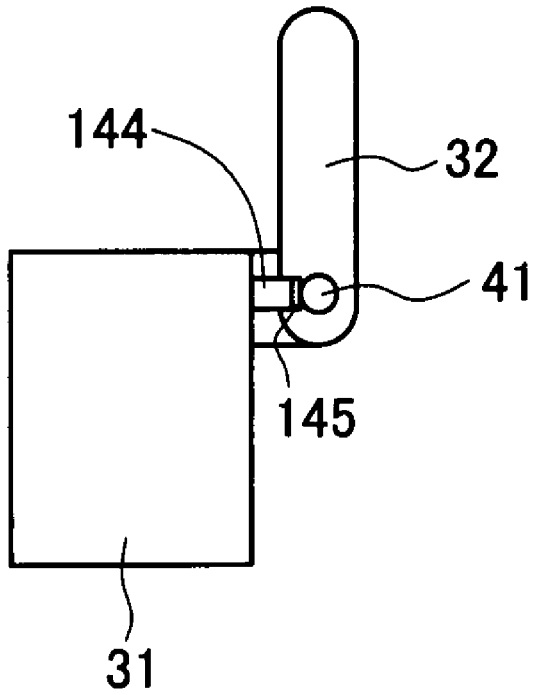
FIG. 36 is a schematic side view showing movement of the fixing lever.

As shown in FIG. 34, a lever supporting shaft 41 of the fixing lever 32 is supported by fulcrums 42 and 143 formed on a front face of the connecting portion 31. In FIG. 34, the fixing lever 32 is not depicted. On a front face of the connecting portion 31, there is formed an engaging portion 144, a prism-shaped convex portion, between the fulcrums 42 and 143. There is formed a concave portion 145 on the front face of the fixing lever 32 downward in FIG. 35. The concave portion 145 is formed on a face which faces outside when the fixing lever 32 is lowered. FIG. 35 and FIG. 36 simplify and show relation of the engaging portion 144 and the concave portion 145, which corresponds to FIG. 34 viewed from its left side.

Under the state as shown in FIG. 35, at least a part of the fixing lever 32 is fixed to the lever supporting shaft 41 at more rear side than the engaging portion 144. Since the engaged portion 144 and the fixing lever 32 get in contact with each other, the fixing lever 32 cannot be moved frontward with this state. That is, it is regulated for the fixing lever 32 to move along the lever supporting shaft 41 leftward in FIG. 34. When the fixing lever 32 is rotated around the lever supporting shaft 41 and lifted, i.e., positioning is changed from FIG. 35 to FIG. 36, the concave portion 145 looks at the side of the connecting portion 31. By setting so, the concave portion 145 of the fixing lever 32 faces to the engaging portion 144 of the connecting portion 31, whereby regulation of the fixing lever 32's sliding is cancelled. FIG. 28 shows the very state of it. Under the state, the fixing lever 32 can be slid along the lever supporting shaft 41.

Figure 37:
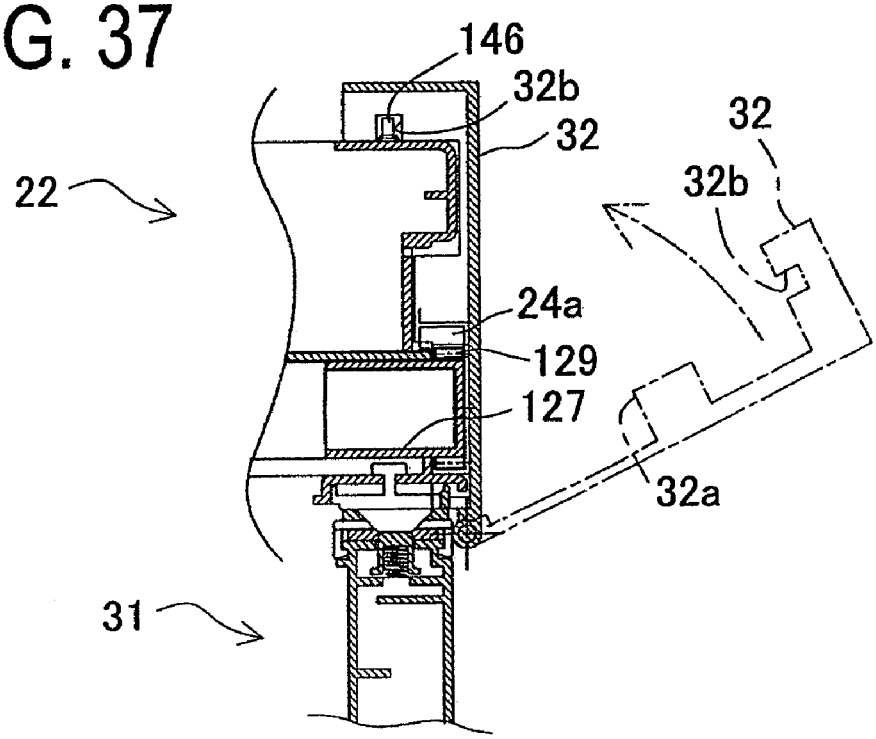
FIG. 37 is a cross sectional view showing the connecting portion of the toner cartridge and the process cartridge.

As shown in FIG. 28, a convex portion 146 is formed on an upper portion of the connecting portion 22. The convex portion 146 is a bar-like member arranged in parallel to the lever supporting shaft 41. The position where the convex portion 146 is formed is a range where a top end portion of the fixing lever 32 does not collide with the convex portion 146 when the fixing lever 32 is lifted. Furthermore, as shown in FIG. 37, a groove 32*b* which gets engaged with the convex portion 146 is formed on the top end portion of the fixing lever 32. Therefore, when the fixing lever 32 in FIG. 28 is slid leftward, the convex portion 146 passes in the groove 32*b* as shown in FIG. 37. That is, lifting and lowering of the fixing lever 32 can be made only within a range where the convex portion 146 is not formed. A range where the convex portion 146 is formed, periphery of the groove 32*b* of the fixing lever 32 is regulated by the convex portion 146.

Judging from the above description, rotation and slide of the fixing lever 32 is allowed only when operation is carried out in accordance with the following order: firstly, set the fixing lever 32 at a position as shown in FIG. 29 and FIG. 30 (a state of hanging down at front side of the connecting portion 31); rotate it upward to set at a position as shown in FIG. 28; and slide it leftward. In the case of contrary order, the fixing lever 32 can be rotated downward after it is slid rightward to reach the position of FIG. 28. While hung down, sliding of the fixing lever 32 is regulated by the engaging portion 144. Furthermore, rotation from upper left to downward is regulated by the convex portion 146 or by corporation of the engaging portion 144 and the concave portion 145. As shown in FIG. 34, a concave portion 24*c* is formed on an upper face of the rack portion 24*a* of the shutter 24 so as to get engaged with an engaging portion 32*a* of the fixing lever 32 for sure. Thereby, the shutter 24 is surely slid along with sliding of the fixing lever 32. With this state, the fixing lever 32 gets engaged with a convex portion 34*b* (see FIG. 32) and the shutter 34 is slid along with sliding of the fixing lever 32.

Next, there will be described operational procedures to attach the toner cartridge 11 and the process cartridge 12 to the color printer 10. These cartridges are inserted in a depth direction from the front side for FIG. 1. When the cartridges are inserted at designated position in the main body, the communicating passage 23 and the communicating passage 33 overlap with each other at substantially coaxial position, as shown in FIG. 29. At the same time, the communicating hole 26 and the communicating hole 37 meet with each other vertically. Under this state, the fixing lever 32 has not been slid and the fixing lever 32 can be rotated around the center of the lever supporting shaft 41 and lifted.

What FIG. 29 and FIG. 30 show is a state that the toner cartridge 11 and the process cartridge 12 are simply inserted into the main body of the color printer 10. The fixing lever 32 has not been lifted and the toner cartridge 11 and the process cartridge 12 have not been connected to each other properly, then. Under this state, both the toner cartridge 11 and the process cartridge 12 can be moved slightly in up, down, left, and right directions. However, since the communicating passage 23 and the communicating passage 33 are closed by the shutter 24 and the shutter 34, respectively, there is no fear of toner leakage to the external. It is more preferable that careless opening of the shutters 24 and 34 as solo items is prevented by an engaging claw or the like.

Figure 38:
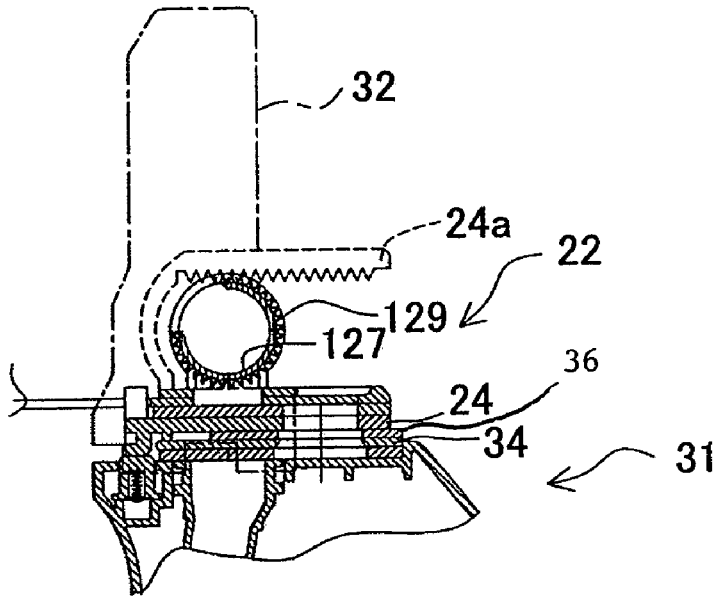
FIG. 38 is a cross sectional view showing the connecting portion of the toner cartridge and the process cartridge.

Therefore, a user pushes the fixing lever 32 to a front face (a face appearing at front side in FIG. 28) of the connecting portion 22 of the toner cartridge 11 while compressing the packing 36 to make the toner cartridge 11 and the process cartridge 12 closer. As shown in FIG. 30, an inner face of the fixing lever 32 is formed out to fit with an outer form of the connecting portion 22. Therefore, the connecting portion 22 is pressed by the fixing lever 32 and vicinity of the lever supporting shaft 41. Thereby, as shown in FIG. 37 and FIG. 38, the packing 36 is compressed and the connecting portion 22 and the connecting portion 31 are fixed at somewhat closer position. At the same time, positioning is made by the receptor portion 34*a* and the convex portion 24*b*. Under this state, the shutter 24, shutter 34 and the cylindrical shutter 127 are set to their close positions. FIG. 28 shows this state.

Under such a state, the fixing lever 32 gets engaged with both a concave portion 24*c* on the rack portion 24*a* (see FIG. 34) and a convex portion 34*b* on the shutter 34 (see FIG. 32) whereas the shutter 24 and the shutter 34 get engaged with each other due to engagement of the convex portion 24*b* and the receptor portion 34*a* (see FIG. 31). On that account, the fixing lever 32, the shutter 24 and the shutter 34 can slide as one body. Next, a user slide them together leftward, in FIG. 38. Since those three items are fixed to move together as a united one under this state, a user can slide them just holding the fixing lever 32. So, he or she slides the fixing lever 32 along the lever supporting shaft 41.

Figure 39:
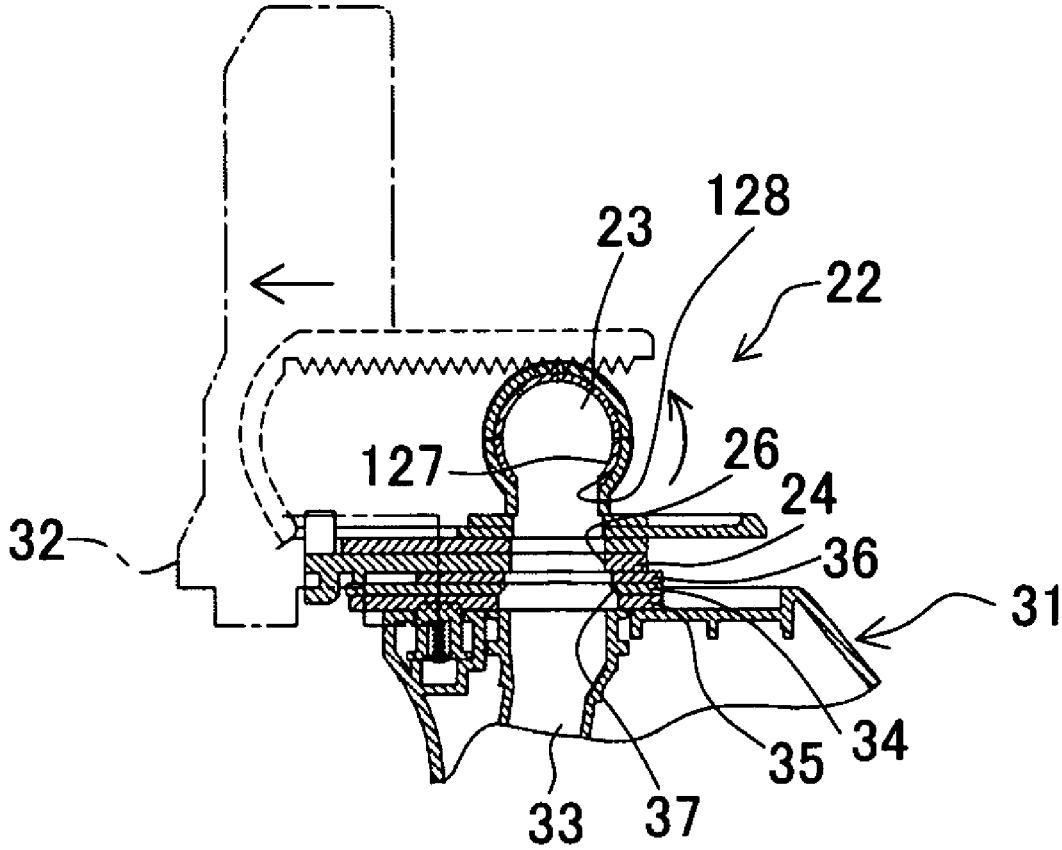
FIG. 39 is a cross sectional view showing the connecting portion of the toner cartridge and the process cartridge.

As a result, positioning shifts as shown in FIG. 39. Since the lever supporting shaft 41 is fixed to the connecting portion 31 of the process cartridge 12, rigidity of it is high. Therefore, stable slide is possible. For example, the fixing lever 32 and the shutter 34 can be slid together by attaching the fixing lever 32 to the shutter 34. However, material of high strength must be used for the shutter 34 to secure sufficient rigidity with such structure.

That is, since the shutter 24 and the shutter 34 are slid leftward in FIG. 38, the rack portion 24*a* is slid leftward, as well. Thereby, the cylindrical shutter 127 is rotated by the gear 129 and the communicating hole 128 of the cylindrical shutter 127 is met with the communicating passage 23 of the toner cartridge 11. Since the rack portion 24*a* gets engaged with the gear 129 from the beginning, the gear 129 does not move unexpectedly. For example, a rack portion may be formed on the fixing lever 32 to get engaged with the gear 129 when fixing lever 32 is lifted. However, with such mechanism, the gear 129 can possibly rotate somewhat depending on engagement condition of the rack portion and the gear 129.

Accordingly, once the toner cartridge 11 and the process cartridge 12 are separately inserted to the main body of the color printer 10 and the fixing lever 32 is lifted and slid leftward, it shifts to passable state as shown in FIG. 39. That is, the communicating passage 23 of the toner cartridge 11 becomes passable to the communicating passage 33 of the process cartridge 12 through the communicating hole 128 of the cylindrical shutter 127, communicating hole 26 of the shutter 24 and the communicating hole 37 of the shutter 34. Nowhere of a toner sending route is opened to the external at any intermediate stages of attaching cartridges. So there is no fear of toner leakage.

Next, there will be described operational procedures to detach the toner cartridge 11 or the process cartridge 12 from the color printer 10. As already described, the fixing lever 32 cannot be rotated downward when it is in passable state as shown in FIG. 39. Accordingly, as long as the state of FIG. 39 is kept, none of the cartridges can be detached. Incidentally, it is not allowed to detach both of the cartridges together.

So, firstly, the fixing lever 32 is slid rightward under passable state. At this time, the fixing lever 32, the shutter 24, and the shutter 34 are slid together as an integrated one, similar to attachment operation. Thereby, it shifts to a state as shown in FIG. 38 and the communicating passages 23 and 33 are closed by the shutters 24 and 34. Then, regulation is cancelled and the fixing lever 32 can be lowered this time. That is, there is no fear that the toner cartridge 11 and the process cartridge 12 are detached with the communicating passages 23 and 33 kept open.

As described in detail, according to the color printer 10 directed to the present embodiment, the shutter 24 and the shutter 34 are provided on the toner cartridge 11 and the process cartridge 12, respectively. Therefore, when those cartridges are in solo item state, toner leakage does not occur to either cartridge. Furthermore, when those cartridges are attached to the main body, the shutter 24 and the shutter 34 are moved together as one body by the fixing lever 32. Therefore, it never occurs that either cartridge gets displaced or one of the shutters opens in the middle of attachment operation. Even though attachment is redone, the cartridges cannot be detached from each other before the shutters 24 and 34 are thoroughly closed. The present embodiment realizes a color printer 10 capable of preventing toner leakage from both a toner housing portion and a process portion with better degree than the first embodiment, and enabling even an unaccustomed user to attach various units without making surroundings dirty.

The embodiments were described above merely as illustrative examples, but it is nothing to limit the invention in any way. Therefore, the invention can obviously be improved or modified in various ways without deviating from its essentials. For instance, in the third embodiment, a boss or the like which corresponds to rotation position of the rotation lever may be provided on the movable cover of the main body. Also, the present invention is applicable to image forming apparatuses such as copier, facsimile, and the like, other than a color printer.

Relating to the imaging cartridge and the image forming apparatus directed to the first aspect of the present invention, it is preferable that the fixing lever makes sliding movement together with the lower shutter and also makes sliding movement together with the upper shutter while fixing the toner cartridge. With such mechanism, the lower shutter and the upper shutter can be slid together along with sliding movement of the fixing lever. Opening and closing those shutters are therefore easy.

Relating the imaging cartridge directed to the first aspect of the present invention, it is preferable that the toner cartridge comprises: a cylindrical shutter which is arranged more upstream of toner flow than the upper shutter, has a toner passage hole, and rotates within an angular range including a closing position to close a toner passage and an opening position to open the toner passage through the toner passage hole; and a gear which rotates together with the cylindrical shutter, and wherein the fixing lever makes sliding movement together with the lower shutter, includes a rack portion provided in parallel to the sliding movement, and makes sliding movement together with the upper shutter on condition that the rack portion gets engaged with the gear while the fixing lever fixes the toner cartridge. With such mechanism, toner leakage is prevented by not only the slide shutter but also the cylindrical shutter. Furthermore, since the cylindrical shutter can be opened simultaneously with sliding of the upper shutter by engagement of the gear and the rack portion, opening and closing of those shutters is easy.

Relating to the imaging cartridge directed to the first or second aspect of the present invention, it is preferable that an elastic bodied packing provided on at least one of faces, namely, a face of the toner cartridge which gets in contact with the process cartridge and a face of the process cartridge which gets in contact with the toner cartridge. By compressing the packing with the toner cartridge and the process cartridge to make them closer, toner leakage between those cartridges can be prevented.

Relating to the process cartridge directed to the third aspect of the present invention preferably further comprises a slide regulating member which regulates sliding movement of the fixing lever when the fixing lever is at a rotation position where the fixing lever does not fix the toner cartridge. Furthermore, the fixing lever preferably includes a regulation canceling portion which clears away the slide regulating member when the fixing lever is at a rotation position where the fixing lever fixes the toner cartridge. With such mechanism, the fixing lever is not slid on condition that the toner cartridge is not fixed. Furthermore, the fixing lever can slide on condition that the toner cartridge is fixed.

What is claimed is:

1. A toner cartridge for housing toner and supplying toner from a toner outlet for forming an image, being attached to an image forming apparatus when used, the toner cartridge comprising:

a shutter which has a toner passage hole and makes sliding movement within a range including a closing position to close the toner outlet and an opening position to open the toner outlet through the toner passage hole;

a cylindrical shutter which is arranged more upstream of toner flow than the shutter, has a toner passage hole, and rotates within an angular range including a closing position to close a toner path and an opening position to open the toner path through the toner passage hole;

a gear which rotates together with the cylindrical shutter; and a rack portion which makes sliding movement together with the shutter, is provided in parallel to direction of the sliding movement, and is engaged with the gear, wherein the shutter and the cylindrical shutter come to opening position together, and come to closing position together.

2. An imaging cartridge divided into a toner cartridge for housing toner and supplying toner from a toner outlet for forming an image and a process cartridge including a process portion for forming an image by receiving supply of toner, both the toner cartridge and the process cartridge being attached to an image forming apparatus when used, wherein the toner cartridge comprises:

an upper shutter which has a toner passage hole and makes sliding movement within a range including a closing position to close the toner outlet and an opening position to open the toner outlet through the toner passage hole;

an engaging portion which makes sliding movement together with the upper shutter and gets engaged with a member of the process cartridge;

a cylindrical shutter which is arranged more upstream of toner flow than the upper shutter, has a toner passage hole, and rotates within an angular range including a closing position to close toner path and an opening position to open the toner path through the toner passage hole;

a gear which rotates together with the cylindrical shutter; and a rack portion which makes sliding movement together with the upper shutter, is provided in parallel to direction of the sliding movement, and engaged with the gear, wherein the upper shutter and the cylindrical shutter come to opening position together, and come to closing position together, wherein the process cartridge comprises a fixing lever which fixes the toner cartridge, gets engaged with the engaging portion and makes sliding movement together with the upper shutter while fixing the toner cartridge.

3. A process cartridge including a process portion for forming an image by receiving toner supplied from a toner inlet, being attached to an image forming apparatus together with a toner cartridge for supplying toner when used, the process cartridge comprising:

a shutter which has a toner passage hole and makes sliding movement within a range including a closing position to close the toner inlet and an opening position to open the toner inlet through the toner passage hole;

fixing lever which fixes the toner cartridge along rotational movement; and a lever supporting shaft which is provided apart from the shutter, and supports the fixing lever in a manner that the fixing lever can rotate and make sliding movement in parallel to sliding movement of the shutter.

4. The process cartridge according to claim 3 further comprising a slide regulating member which regulates sliding movement of the fixing lever when the fixing lever is at a rotation position where the fixing lever does not fix the toner cartridge.

5. The processing cartridge according to claim 4 wherein the fixing lever includes a regulation canceling portion which clears away the slide regulating member when the fixing lever is at a rotation position where the fixing lever fixes the toner cartridge.

6. An imaging cartridge divided into a toner cartridge for housing toner and supplying toner from a toner outlet for forming an image and a process cartridge including a process portion for forming an image by receiving toner supplied from a toner inlet, both the toner cartridge and the process cartridge being attached to an image forming apparatus when used, wherein the toner cartridge comprises:

an upper shutter which has a toner passage hole and makes sliding movement within a range including a closing position to close the toner outlet and an opening position to open the toner outlet through the toner passage hole; and an upper positioning-and-engaging portion which makes sliding movement together with the upper shutter and gets engaged with a member of the process cartridge, wherein the process cartridge comprises:

a lower shutter which has a toner passage hole and makes sliding movement within a range including a closing position to close the toner inlet and an opening position to open the toner inlet through the toner passage hole; and a lower positioning-and-engaging portion which makes sliding movement together with the lower shutter and gets engaged with the upper positioning-and-engaging portion, wherein the upper positioning-and-engaging portion and the lower positioning-and-engaging portion get engaged with each other at a position where the toner passage hole of the upper shutter and the toner passage hole of the lower shutter meet each other, wherein the upper shutter and the lower shutter come to opening positions together and come to closing positions together when the upper positioning-and-engaging portion and the lower positioning-and-engaging portion get engaged with each other.

7. An imaging cartridge divided into a toner cartridge for housing toner and supplying toner from a toner outlet for forming an image and a process cartridge including a process portion for forming an image by receiving supply of toner, both the toner cartridge and the process cartridge being attached to an image forming apparatus when used, wherein the toner cartridge comprises:

an upper shutter which has a toner passage hole and makes sliding movement within a range including a closing position to close the toner outlet and an opening position to open the toner outlet through the toner passage hole;

a first engaging portion which makes sliding movement together with the upper shutter and gets engaged with a member of the process cartridge; and a second engaging portion which is arranged apart from the upper shutter and gets engaged with a member of the process cartridge, wherein the process cartridge comprises:

a fixing lever which is capable of making both sliding movement in parallel to the upper Shutter's sliding movement and rotational movement around slide axis of the sliding movement, and fixes the toner cartridge by rotational movement;

a third engaging portion which is provided on the fixing lever, and gets engaged with the first engaging portion and enable the fixing lever and the upper shutter to make sliding movement as one when the toner cartridge is fixed by the fixing lever; and a fourth engaging portion which is provided on the fixing lever, and gets engaged with the second engaging portion and blocks rotational movement of the fixing lever when the toner cartridge is fixed by the fixing lever and the upper shutter is slid to the opening position.

* * * * *